US009673519B2

(12) United States Patent
Tatarnikov et al.

(10) Patent No.: US 9,673,519 B2
(45) Date of Patent: Jun. 6, 2017

(54) GROUND PLANES FOR REDUCING MULTIPATH RECEPTION BY ANTENNAS

(71) Applicant: Topcon Positioning Systems, Inc., Livermore, CA (US)

(72) Inventors: Dmitry Vitalievich Tatarnikov, Moscow (RU); Andrey Vitalievich Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 253 days.

(21) Appl. No.: 14/357,447

(22) PCT Filed: Apr. 11, 2013

(86) PCT No.: PCT/RU2013/000312

§ 371 (c)(1),
(2) Date: May 9, 2014

(87) PCT Pub. No.: WO2014/168505

PCT Pub. Date: Oct. 16, 2014

(65) Prior Publication Data

US 2015/0015451 A1 Jan. 15, 2015

(51) Int. Cl.
*H01Q 1/48* (2006.01)
*H01Q 3/44* (2006.01)
(Continued)

(52) U.S. Cl.
CPC ..... *H01Q 1/48* (2013.01); *H01Q 3/44* (2013.01); *H01Q 15/14* (2013.01); *H01Q 19/10* (2013.01)

(58) Field of Classification Search
CPC H01Q 1/48; H01Q 3/44; H01Q 3/446; H01Q 15/0013; H01Q 15/006;
(Continued)

(56) References Cited

U.S. PATENT DOCUMENTS 5,694,136 A 12/1997 Westfall
6,512,494 B1 * 1/2003 Diaz ..... H01Q 7/00 343/842
(Continued)

FOREIGN PATENT DOCUMENTS

RU 2368040 C1 9/2009
RU 2446522 C2 3/2012
WO 2011061589 A1 5/2011

OTHER PUBLICATIONS

Dmitry Tatarnikov, "Topcon Full Wave Reference Station Antenna with Convex Impedance Ground plane", Feb. 2012, Topcon, pp. 1-18.*
International Search Report and Written Opinion issued on Feb. 6, 2014, for the corresponding international patent application No. PCT/RU2013/000312, 6 pages.
(Continued)

*Primary Examiner* — Graham Smith
*Assistant Examiner* — Patrick Holecek
(74) *Attorney, Agent, or Firm* — Chiesa Shahinian & Giantomasi PC

(57) ABSTRACT

An antenna system for a global navigation satellite system reference base station is disclosed. The antenna system includes an antenna positioned above a high capacitive impedance surface (HCIS) ground plane. Over a specific range of the lateral dimension of the HCIS ground plane and the height of the antenna above the HCIS ground plane, a high level of multipath suppression and high sensitivity for low-elevated satellites can be simultaneously maintained. The HCIS ground plane can be fabricated as a flat conducting plate with an array of conducting elements such as pins, pins with expanded tips, or mushroom structures. Alternatively, the HCIS can be fabricated as a flat conducting plate with a concentric series of choke rings. The antenna system can provide a positioning accuracy of +/−1 mm, an order of magnitude improvement over previous designs.

14 Claims, 16 Drawing Sheets

(51) Int. Cl.
*H01Q 15/14* (2006.01)
*H01Q 19/10* (2006.01)

(58) Field of Classification Search
CPC .... H01Q 15/0073; H01Q 15/008; H01Q 1/24; H01Q 1/241; H01Q 1/242; H01Q 1/243; H01Q 1/245; H01Q 1/246; H01Q 1/247; H01Q 1/27; H01Q 1/273; H01Q 1/32
See application file for complete search history.

(56) References Cited

U.S. PATENT DOCUMENTS 6,836,247 B2 12/2004 Soutiaguine et al.
8,174,450 B2 * 5/2012 Tatarnikov ..... H01Q 9/0407 343/700 MS
8,441,409 B2 * 5/2013 Tatarnikov ..... H01Q 15/16 343/700 MS

OTHER PUBLICATIONS

J. M. Tranquilla, et al., "Analysis of a Choke Ring Groundplane for Multipath Control in Global Positioning System (GPS) Applications", IEEE Transactions on Antennas and Propagation, vol. 42, No. 7, pp. 905-911, Jul. 1994.
D. Sievenpiper, L Zhang, R. F. J. Broas, N. G. Alexopolous, and E. Yablonovitch, "High-impedance electromagnetic surfaces with a forbidden frequency," IEEE Trans. Microw. Theory Tech., vol. 47, No. 11, pp. 2059-2074, Nov. 1999.
R. J. King, D. V. Thiel, K. S. Park "The synthesis of surface reactance using an artificial dielectric", IEEE Trans, AP, vol. 31, 471-476.,1983.
D. Tatarnikov, A. Astakhov, A. Stepanenko, "Broadband Convex Impedance Ground Planes for Multi-System GNSS Reference Station Antennas GPS Solutions", v15, N2, 2011, pp. 101-108.
C. R. Simovski et al., "High-Impendance Surfaces Having Stable Resonance with Respect to Polarization and Incidence Angle", IEEE Transactions on Antennas and Propagation, vol. 53, No. 3, Mar. 2005, pp. 908-914.

* cited by examiner

120A

FIG. 12C
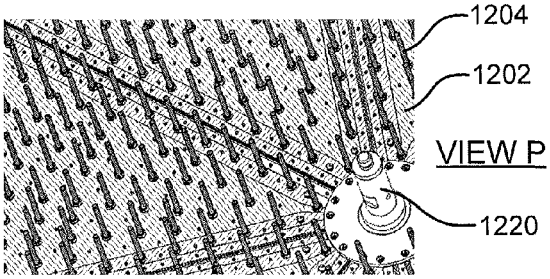
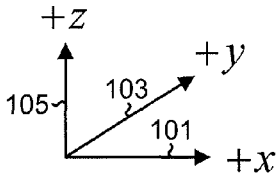
FIG. 12A
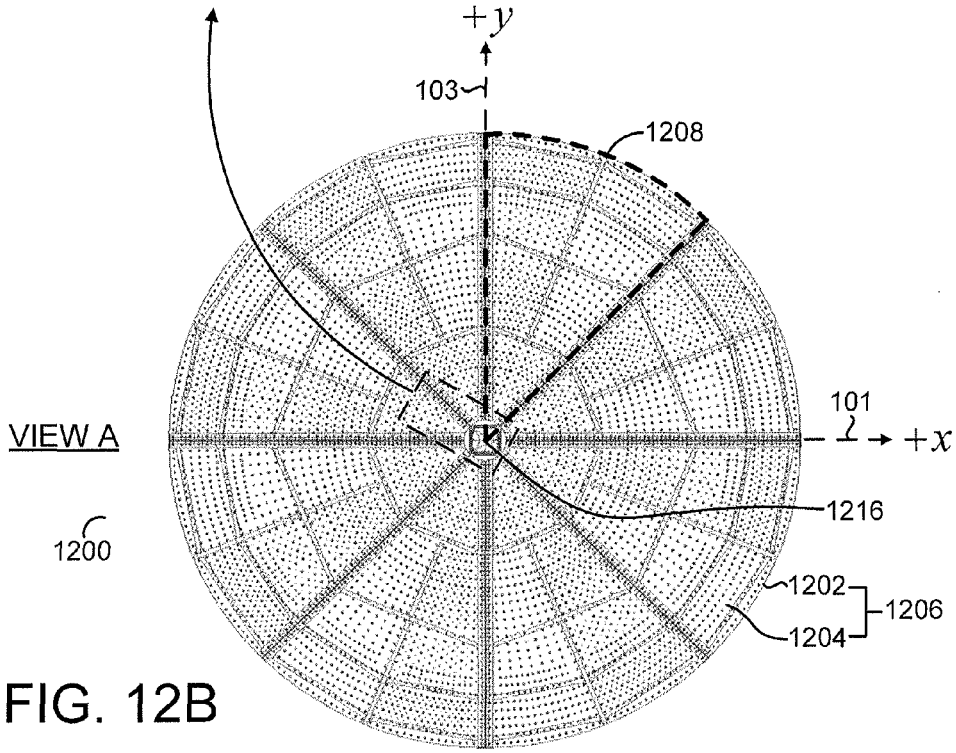
FIG. 12B
FIG. 12D
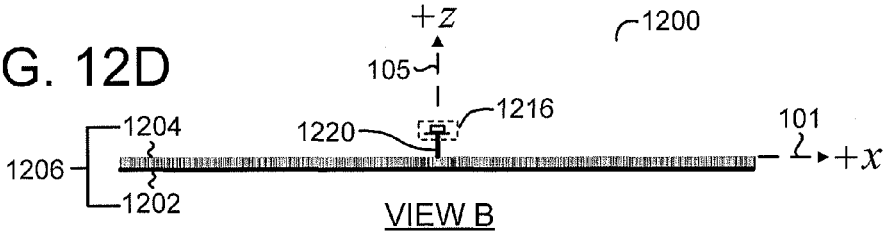

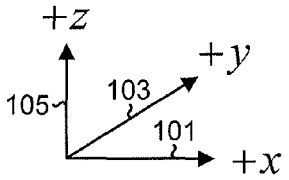
FIG. 13A
FIG. 13B
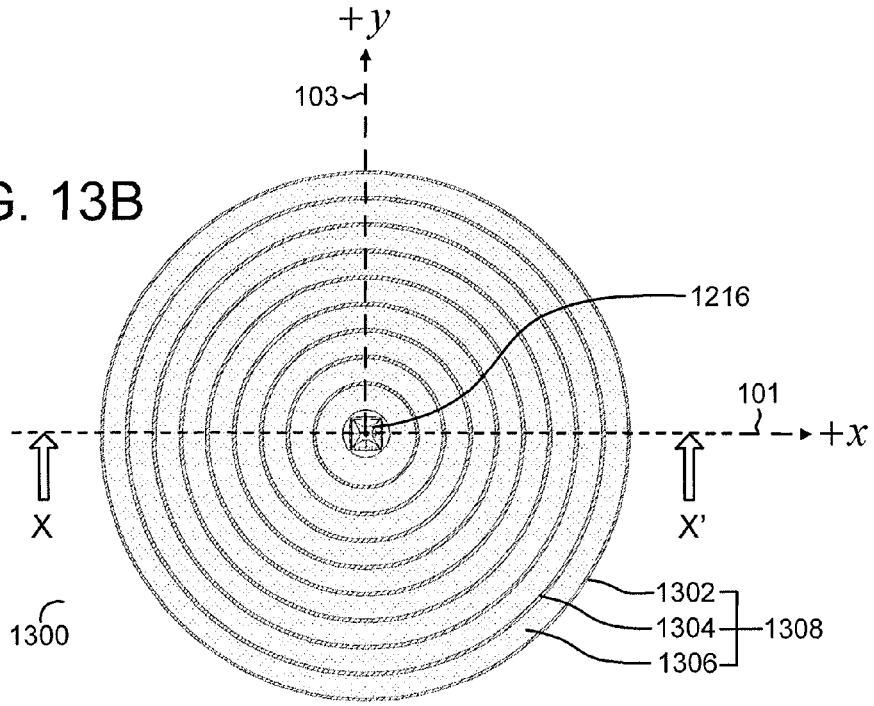
VIEW A
FIG. 13C
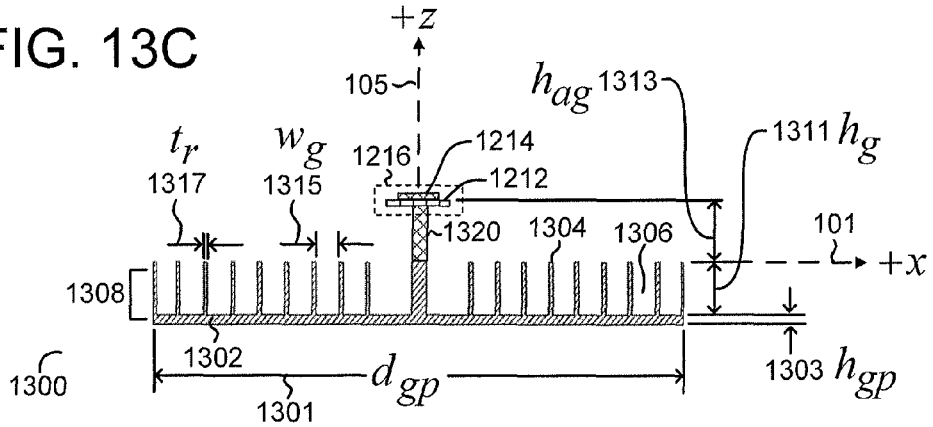
VIEW X-X'

VIEW A
1404
1402

VIEW A
1411
1421
1401
1404
VIEW B
1402
1400
VIEW C 1413
1404
1402
1403
VIEW C

VIEW A
1504
1402

VIEW A
1511
1521
1401
1504
VIEW B
1402
1500
VIEW C 1513
1504
1402
1403
VIEW C

VIEW A
1604
1402

VIEW A
1611
1621
1401
1604
VIEW B
1402
1600
VIEW C 1613
1604
1402
1403
VIEW C

VIEW A
1704
1402

VIEW A
1711
1721
1401
1704
VIEW B
1402
1700
VIEW C 1713
1704
1402
1403
VIEW C

GROUND PLANES FOR REDUCING MULTIPATH RECEPTION BY ANTENNAS

BACKGROUND OF THE INVENTION

The present invention relates generally to antennas, and more particularly to ground planes for reducing multipath reception by antennas.

Global navigation satellite systems (GNSSs) can determine locations with high accuracy. Currently deployed global navigation satellite systems are the United States Global Positioning System (GPS) and the Russian GLONASS. Other global navigation satellite systems, such as the European GALILEO system, are under development. In a GNSS, a navigation receiver receives and processes radio signals transmitted by satellites located within a line-of-sight of the receiver. The satellite signals comprise carrier signals modulated by pseudo-random binary codes. The receiver measures the time delays of the received signals relative to a local reference clock or oscillator. Code measurements enable the receiver to determine the pseudo-ranges between the receiver and the satellites. The pseudo-ranges differ from the actual ranges (distances) between the receiver and the satellites due to various error sources and due to variations in the time scales of the satellites and the receiver. If signals are received from a sufficiently large number of satellites, then the measured pseudo-ranges can be processed to determine the code coordinates and coordinate time scales at the receiver. This operational mode is referred to as a stand-alone mode, since the measurements are determined by a single receiver. A stand-alone system typically provides meter-level accuracy.

To improve the accuracy, precision, stability, and reliability of measurements, differential navigation (DN) systems have been developed. In a DN system, the position of a user is determined relative to a reference base station. The reference base station is typically fixed, and the coordinates of the reference base station are precisely known; for example, by surveying. The reference base station contains a navigation receiver that receives satellite signals and that can determine the coordinates of the reference base station by GNSS measurements.

The user, whose position is to be determined, can be stationary or mobile; in a DN system, the user is often referred to as a rover. The rover also contains a navigation receiver that receives satellite signals. Signal measurements processed at the reference base station are transmitted to the rover via a communications link. To accommodate a mobile rover, the communications link is often a wireless link. The rover processes the measurements received from the reference base station, along with measurements taken with its own receiver, to improve the accuracy of determining its position. Accuracy is improved in the differential navigation mode because errors incurred by the receiver at the rover and by the receiver at the reference base station are highly correlated. Since the coordinates of the reference base station are accurately known, measurements from the reference base station can be used to compensate for the errors at the rover. A differential global positioning system (DGPS) computes positions based on pseudo-ranges only.

The position determination accuracy of a differential navigation system can be further improved by supplementing the code pseudo-range measurements with measurements of the phases of the satellite carrier signals. If the carrier phases of the signals transmitted by the same satellite are measured by both the navigation receiver in the reference base station and the navigation receiver in the rover, processing the two sets of carrier phase measurements can yield a position determination accuracy to within a fraction of the carrier's wavelength: accuracies on the order of 1-2 cm can be attained. A differential navigation system that computes positions based on real-time carrier signals, in addition to the code pseudo-ranges, is often referred to as a real-time kinematic (RTK) system.

Signal processing techniques can correct certain errors and improve the position determination accuracy. A major source of the uncorrected errors is multipath reception by the receiving antenna. In addition to receiving direct signals from the satellites, the antenna receives signals reflected from the environment around the antenna. The reflected signals are processed along with the direct signals and cause errors in the time delay measurements and errors in the carrier phase measurements. These errors subsequently cause errors in position determination. Multipath reception, in particular, can be a major source of error for accurately determining the position of a reference base station by GNSS. Method and apparatus for reducing multipath reception would be advantageous.

BRIEF SUMMARY OF THE INVENTION

An antenna system configured to receive circularly polarized electromagnetic radiation from a plurality of satellites in a global navigation satellite system includes a high capacitive impedance surface (HCIS) ground plane and an antenna positioned above the HCIS ground plane. The down/up ratio of the antenna in the nadir direction has a user-defined maximum value. The HCIS ground plane has a characteristic lateral dimension that is selected such that the down/up ratio of the antenna system at a user-defined elevation angle has a user-defined maximum value; the user-defined elevation angle corresponds to low-elevated satellites. The height of the antenna above the HCIS ground plane is selected such that the antenna pattern level at the user-defined elevation angle has a user-defined minimum value.

These and other advantages of the invention will be apparent to those of ordinary skill in the art by reference to the following detailed description and the accompanying drawings.

BRIEF DESCRIPTION OF THE DRAWINGS

FIG. 12A-FIG. 12F show schematics of an embodiment of an antenna system with a high capacitive impedance surface ground plane;

FIG. 13A-FIG. 13C show schematics of an embodiment of an antenna system with a high capacitive impedance surface ground plane;

DETAILED DESCRIPTION

Figure 1:
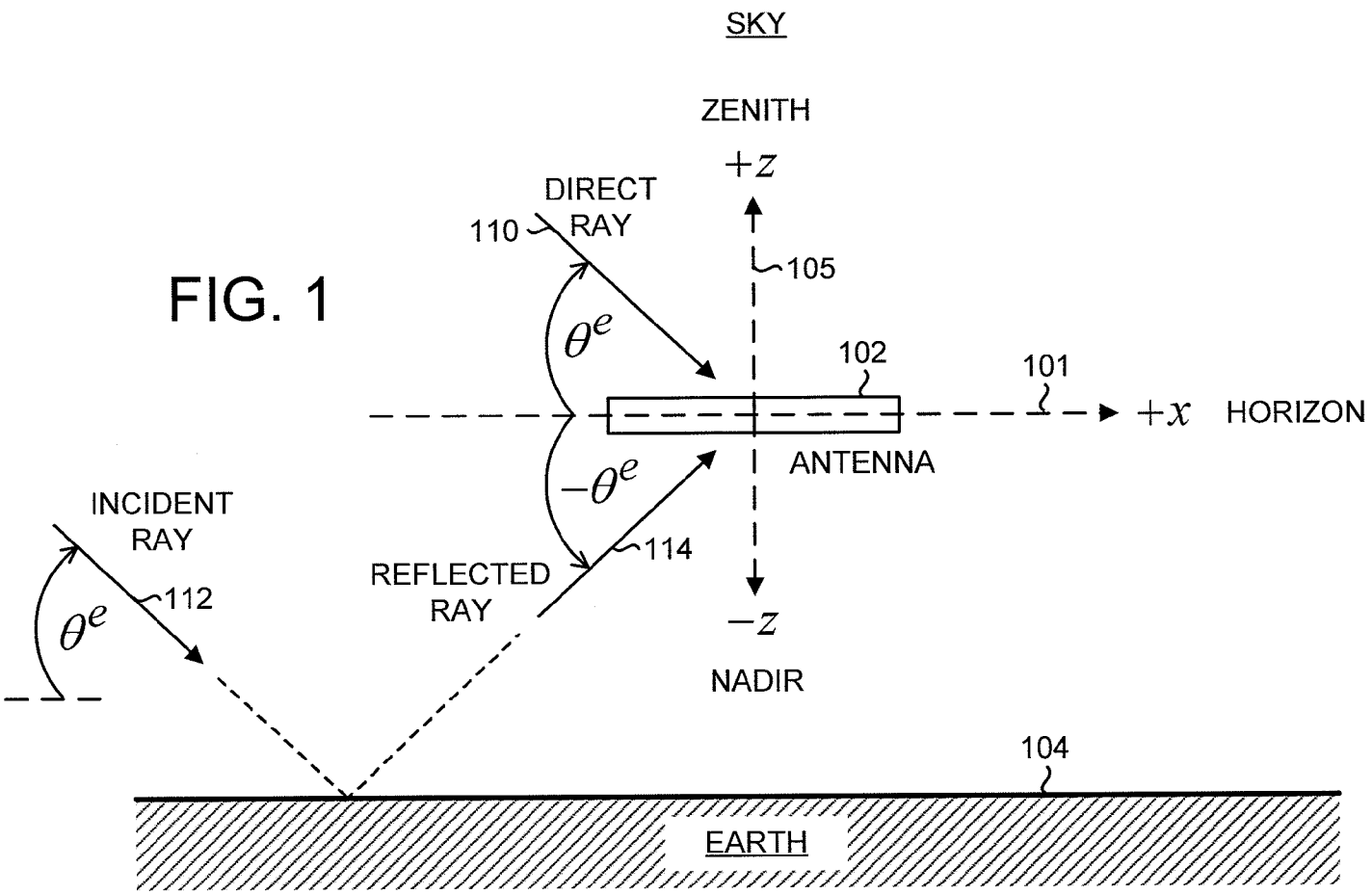
FIG. 1 shows a reference geometry for direct and reflected rays.

FIG. 1 shows a schematic of an antenna 102 positioned above the Earth 104. Herein, the term Earth includes both land and water environments. To avoid confusion with "electrical" ground (as used in reference to a ground plane), "geographical" ground (as used in reference to land) is not used herein. To simplify the drawing, supporting structures for the antenna are not shown. Shown is a reference Cartesian coordinate system with x-axis 101 and z-axis 105. The y-axis (not shown) points into the plane of the figure. In an open-air environment, the +z (up) direction, referred to as the zenith, points towards the sky, and the −z (down) direction, referred to as the nadir, points towards the Earth. The x-y plane lies along the local horizon plane.

In FIG. 1, electromagnetic waves are represented by rays with an elevation angle $\theta^e$ with respect to the horizon. The horizon corresponds to $\theta^e$=0 deg; the zenith corresponds to $\theta^e$=+90 deg; and the nadir corresponds to $\theta^e$=−90 deg. Rays incident from the open sky, such as ray 110 and ray 112, have positive values of elevation angle. Rays reflected from the Earth 104, such as ray 114, have negative values of elevation angle. Herein, the region of space with positive values of elevation angle is referred to as the direct signal region and is also referred to as the forward (or top) hemisphere. Herein, the region of space with negative values of elevation angle is referred to as the multipath signal region and is also referred to as the backward (or bottom) hemisphere. Ray 110 impinges directly on the antenna 102 and is referred to as the direct ray 110; the angle of incidence of the direct ray 110 with respect to the horizon is $\theta^e$. Ray 112 impinges directly on the Earth 104; the angle of incidence of the ray 112 with respect to the horizon is $\theta^e$. Assume ray 112 is specularly reflected. Ray 114, referred to as the reflected ray 114, impinges on the antenna 102; the angle of incidence of the reflected ray 114 with respect to the horizon is $-\theta^e$.

To numerically characterize the capability of an antenna to mitigate the reflected signal, the following ratio is commonly used:

$$DU(\theta^e) = \frac{F(-\theta^e)}{F(\theta^e)}. \tag{E1}$$

The parameter DU ($\theta^e$) (down/up ratio) is equal to the ratio of the antenna pattern level F ($-\theta^e$) in the backward hemisphere to the antenna pattern level F ($\theta^e$) in the forward hemisphere at the mirror angle, where F represents a voltage level. Expressed in dB, the ratio is:

$$DU(\theta^e)(dB)=20 \log DU(\theta^e). \tag{E2}$$

Figure 2:
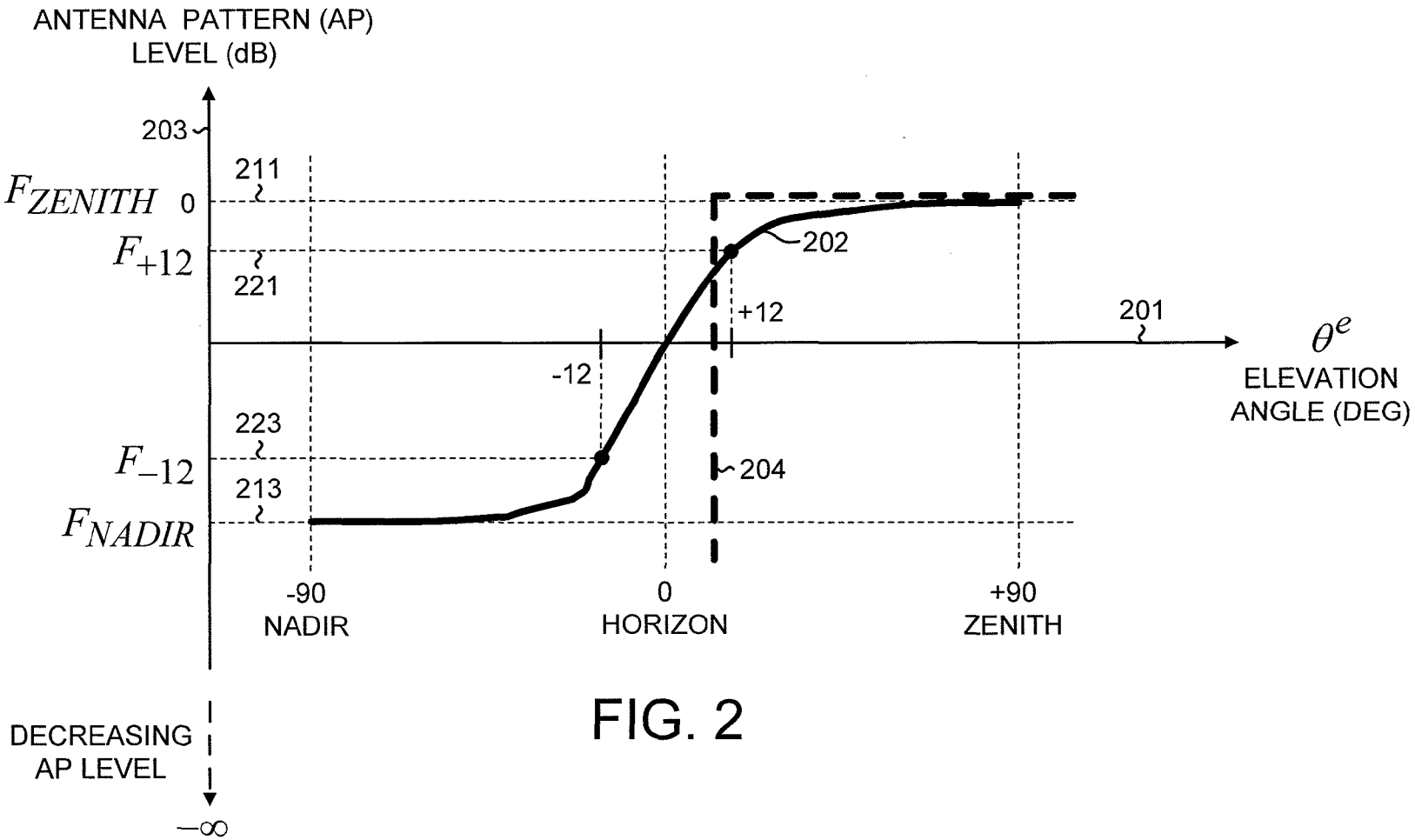
FIG. 2 shows plots of antenna pattern levels as a function of elevation angle.

FIG. 2 shows a representative plot 202 for the antenna pattern of a global navigation satellite system (GNSS) antenna. The horizontal axis 201 represents the elevation angle $\theta^e$ in deg. The vertical axis 203 represents the antenna pattern (AP) level in dB. The peak AP level occurs at the zenith ($\theta^e$=+90 deg); the AP level at the zenith, referenced as $F_{ZENITH}$ 211, is set at 0 dB. The AP level at the nadir ($\theta^e$=−90 deg) is referenced as $F_{NADIR}$ 213.

An elevation mask from about 10 deg to about 12 deg is commonly used with positioning algorithms: signals from satellites with elevation angles less than approximately 10 deg to 12 deg are not included in the signal processing since these signals contribute to large errors in positioning calculations. Signals from "low-elevated" satellites (satellites with elevation angles slightly above approximately 10 deg to 12 deg), however, are of prime importance in positioning calculations; they define the dilution of precision (DOP) factor.

Signals from low-elevated satellites are specularly reflected; the incident angle of the reflected signals corresponds to an elevation angle from about −10 deg to about −12 deg. An ideal GNSS antenna would then have an ideal antenna pattern as shown in plot 204. The AP level is constant (0 dB) from the zenith down to approximately 10 deg to 12 deg elevation angle. Below the approximately 10 deg to 12 deg elevation angle, there is a sharp cutoff to minus infinity. This sharp cutoff suppresses reception of all reflected signals. Achieving the ideal step-like antenna pattern, however, would require an antenna of infinitely large size.

Plot 202 in FIG. 2 shows an example of an antenna pattern that can be achieved in practice. In addition to $F_{ZENITH}$ 211 and $F_{NADIR}$ 213, two other characteristic AP levels are referenced in FIG. 2: $F_{+12}$ 221 is the AP level (in dB) at $\theta^e$=+12 deg; and $F_{-12}$ 223 is the AP level (in dB) at $\theta^e$=−12 deg. The AP level $F_{+12}$ 221 characterizes the capability of the GNSS antenna to track signals from low-elevated satellites. From the discussion above, it is desirable for $F_{+12}$ to be as large as possible (that is, to approach 0 dB). Typically, as the elevation angle decreases from +12 deg to the nadir, the AP level decreases. $F_{-12}$ can roughly characterize the capability of the GNSS antenna to suppress reception of multipath signals. From the discussion above, it is desirable for $F_{-12}$ to be as small as possible (that is, to approach minus infinity). Overall, it is desirable, as the elevation angle decreases from about +(10 to 12) deg to about −(10 to 12) deg, for the AP level to decrease as sharply as possible (that is, for the slope to approach minus infinity).

As discussed above, high accuracy for determining the position of reference base stations by GNSS is important for differential navigation systems. A choke-ring antenna is commonly used for reference base stations (see, for example, J. M. Tranquilla, et al., "Analysis of a Choke Ring Groundplane for Multipath Control in Global Positioning System (GPS) Applications", IEEE Transactions on Antennas and Propagation, Vol. 42, No. 7, pp. 905-911, July 1994). The choke-ring antenna includes an antenna element which is flush mounted directly on a choke-ring ground plane. Typical characteristic AP levels for a choke-ring antenna are $F_{+12}$=−13 dB, $F_{-12}$=−20 dB, and $F_{NADIR}$=−25 dB to −30 dB. A positioning accuracy on the order of +/−1 cm can be attained with a conventional choke-ring antenna.

Although GNSS antennas are used in the receive mode, standard antenna engineering practice calls for analysis of antenna properties in the transmit mode. According to the well-known antenna reciprocity theorem, however, antenna characteristics in the transmit mode correspond to antenna characteristics in the receive mode.

Herein, when geometrical requirements are specified, the geometrical requirements are satisfied if they are satisfied within a user-specified tolerance (the user refers, for example, to an antenna engineer). The user-specified tolerance accounts for practical manufacturing variations and for trade-offs between manufacturing costs and acceptable performance. For example, two lengths are equal if they are equal to within a user-specified tolerance; and two axes are orthogonal if the angle between them is 90 deg +/− a user-specified tolerance.

Figure 3:
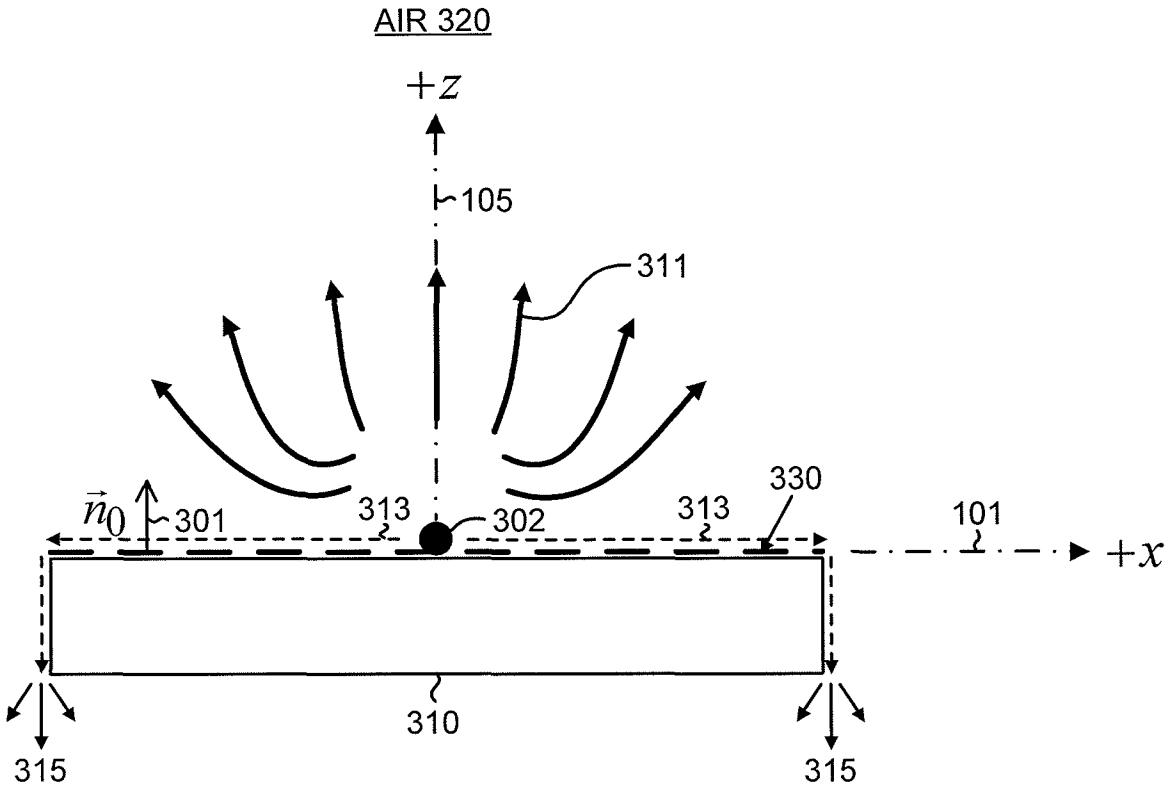
FIG. 3 shows a schematic representation of electromagnetic field distribution around a high capacitive impedance surface ground plane.

According to embodiments of the invention, antenna systems utilize a high capacitive impedance surface (HCIS) ground plane. The theoretical basis of a HCIS is first described. FIG. 3 schematically illustrates impedance boundary conditions. An excitation source 302 (such as an antenna) is positioned on the top surface of the ground plane 310. The boundary surface 330, represented by the thick dashed line, separates two media: air 320 and the ground plane 310. Shown is the unit normal vector 301 $\vec{n}_0$ orthogonal to the boundary surface 330. The following condition holds for impedance boundary conditions:

$$\vec{E}_\tau = -Z_S \vec{H}_\tau \times \vec{n}_0, \tag{E3}$$

where $\vec{E}_\tau$ is the component of the electric field vector tangential to the boundary surface 330, $\vec{H}_\tau$ is the component of the magnetic field vector tangential to the boundary surface 330, and $Z_S$ is the surface impedance.

There are two limiting cases for $Z_S$:$Z_S$=0 is referred to as the short-circuit condition; and $Z_S \to \infty$ is referred to as the open-circuit condition. The short-circuit condition $Z_S$=0 strictly holds if the surface of the ground plane is perfectly flat and if the ground plane is fabricated from a perfect conductor with zero resistivity. In practice, it is a good approximation for flat metal ground planes fabricated from good conductors such as copper or aluminum. To obtain the open-circuit condition $Z_S \to \infty$, the ground plane is fabricated with a dense array (grid) of conducting elements, described in detail below. A "dense" array refers to an array in which the lateral spacing between conductive elements is small compared to the wavelength of the electromagnetic radiation received by or transmitted from the antenna.

Antennas are designed to operate over a specific frequency range of interest. For the short-circuit condition $Z_S$=0, the structure of the ground plane is independent of frequency. For the open-circuit condition $Z_S \to \infty$, however, the structure of the ground plane is dependent on the frequency. Strictly, the open-circuit condition $Z_S \to \infty$ holds only at the resonant frequency of the array of conducting elements.

For the applications of interest, $Z_S$ is almost purely reactive; that is, the active (resistive) component of the impedance is small. A small (ideally zero) resistive component is desirable for two reasons. First, the resistive component contributes to signal power loss, which is undesirable. Second, the resonance required to achieve high values of $Z_S$ approaching the desired open-circuit condition is hard to realize if the resistive component is significant.

Figure 4:
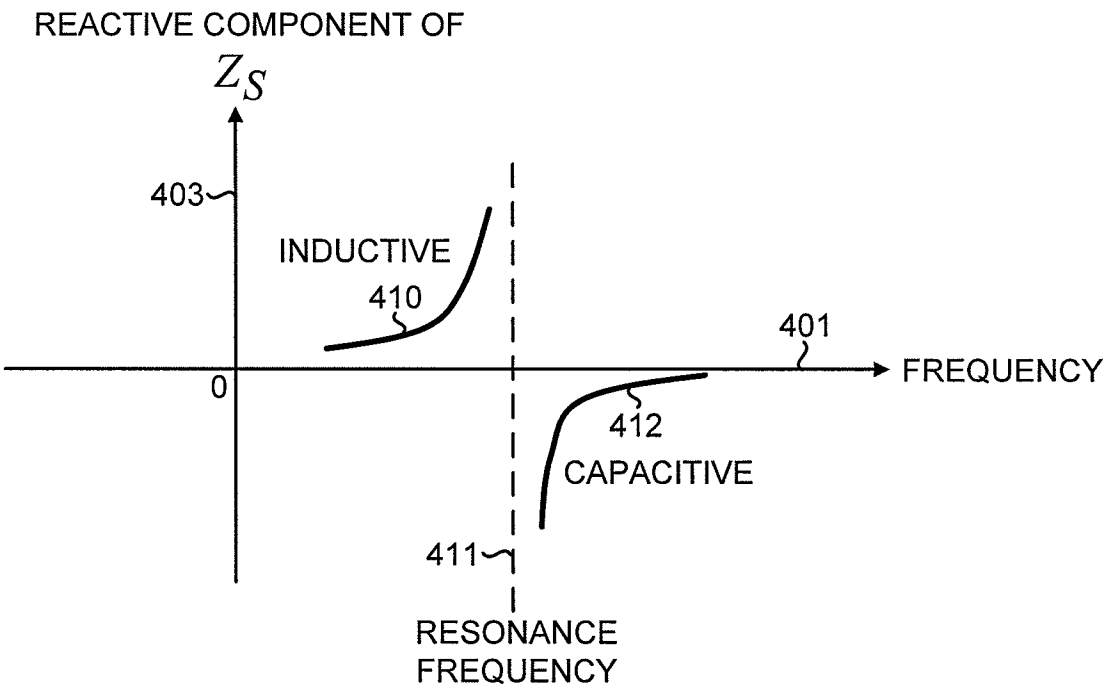
FIG. 4 shows a plot of the reactive component of surface impedance as a function of frequency.

Typical frequency response for pure reactive $Z_S$ at the frequencies near resonance is shown schematically in FIG. 4. The horizontal axis 401 represents the frequency; and the vertical axis 403 represents the reactive component of $Z_S$. The vertical dashed line marks the resonance frequency 411. The open-circuit condition $Z_S \to \infty$ is attained at the resonance frequency. At frequencies below resonance, the impedance is inductive, with the reactive component of $Z_S$ being positive (plot 410). At frequencies above resonance, the impedance is capacitive, with the reactive component of $Z_S$ being negative (plot 412). At frequencies far from resonance (much lower or much higher) the magnitude of the impedance becomes small, which is unsuitable for the applications of interest. Inductive $Z_S$ is forbidden for applications of interest, because an inductive impedance results in excitation of a surface wave, which destroys the desired functionality of the ground plane.

Small deviations of the structure of the ground plane are unavoidable with the manufacturing process. These deviations can cause the resonance frequency to be shifted slightly upwards and $Z_S$ can, in some instances, become inductive in the frequency range of interest. As discussed above, an inductive $Z_S$ is forbidden. Therefore, in practice, the structure of the ground plane is designed such that $Z_S$ is as high as possible while ensuring that the resonance frequency remains strictly below the operating frequency range of interest.

For embodiments of the invention described herein, a high capacitive impedance surface (HCIS) ground plane is desirable; that is the reactive component of $Z_S$ is capacitive and the open-circuit condition at resonance $Z_S \to \infty$ is as closely approximated as is practical. The reason a HCIS ground plane is desirable is discussed below. Following common practice in antenna engineering, a two-dimensional problem is considered instead of the actual three-dimensional problem. The analysis is simplified, and basic results relevant to antenna pattern performance hold approximately for the three-dimensional problem. Consider a two-dimensional problem corresponding to the configuration shown in FIG. 3. If a short-circuit condition $Z_S$=0 holds, then an electric current $\vec{j}_S$ flowing along the surface of the ground plane decays as $$j_S \sim 1/\sqrt{k|x|}, \tag{E4}$$

where $j_S$ is the magnitude of $\vec{j}_S$, |x| is the lateral distance from the excitation source (positioned at x=0) [refer to FIG. 3], and $k=2\pi/\lambda$, where k is the wavenumber and λ is the wavelength of interest.

With a high capacitive $Z_S$, however, the electric and magnetic fields along the boundary surface decay as $$E_\tau \sim \frac{1}{Z_S}\frac{1}{(k|x|)^{3/2}} \tag{E5A}$$

and $$H_\tau \sim \left(\frac{1}{Z_S}\right)^2 \frac{1}{(k|x|)^{3/2}}. \tag{E5B}$$

These values decay much faster than the value in (E4). The expressions (E5A) and (E5B) also show that $E_\tau$ is inversely proportional to $Z_S$ and $H_\tau$ is inversely proportional to the square of $Z_S$; therefore, as $Z_S$ increases, the fields decay faster. Fast decay of the fields is desirable for the following reason.

Refer back to FIG. 3. Consider the antenna operating in the transmit mode. If the boundary surface 330 is a high capacitive impedance surface (HCIS), then the electromagnetic waves travelling from the excitation source 302 would leave the surface faster than they would if the boundary surface were that of a flat conductor. The electromagnetic field distribution is shown schematically in FIG. 3. The vectors 311 represent the electromagnetic field radiating towards the open sky. The electromagnetic field 313, shown as a thin dashed line, represents the electromagnetic field travelling along the boundary surface 330. If the boundary surface is a HCIS, then the electromagnetic field 313 decays rapidly as it propagates from the excitation source towards the edges (outer perimeter) of the HCIS, resulting in only a small portion of the radiated power reaching the edges of the HCIS. Therefore, only a small portion of the radiated power will diffract over the edges of the ground plane 310 and propagate in directions below the ground plane 310. The vectors 315 represent the electromagnetic field radiating towards the Earth.

In the transmit mode, with a HCIS, the antenna pattern levels for the directions below the antenna are therefore small compared to the antenna pattern levels for directions above the antenna. In the receive mode, the HCIS correspondingly suppresses reception of multipath signals propagating from below the antenna; as discussed above, suppression of multipath signals is desirable. In the transmit mode, "forcing" the electromagnetic waves travelling from the excitation source to leave the high capacitive impedance surface, however, also results in narrowing the antenna pattern for directions close to grazing. In the receive mode, this effect corresponds to reduced sensitivity to signals from low-elevated satellites; as discussed above, reduced sensitivity to signals from low-elevated satellites is not desirable. It would appear, therefore, that a HCIS would not be suitable for GNSS applications.

According to embodiments of the invention, an antenna system includes an antenna positioned above a high capacitive impedance surface (HCIS) ground plane. A HCIS ground plane is a ground plane with a structure configured to generate a high capacitive impedance surface on the ground plane. Analyses and measurements unexpectedly show that, with a proper choice of design parameters, these antenna systems can simultaneously yield both high multipath suppression and high sensitivity to signals from low-elevated satellites. The antenna systems are therefore well suited for GNSS applications.

As discussed above, minimizing the $F_{-12}$ AP level is advantageous for suppressing the reception of multipath signals. In the prior art, a common way to decrease the $F_{-12}$ AP level is to increase the size of the ground plane. In the transmit mode, the radiated power reaching the edges of the ground plane is reduced, less power is diffracted over the edges of the ground plane, and the field intensity below the antenna is reduced (FIG. 3). With an HCIS ground plane, however, an increase in the size of the ground plane narrows the antenna pattern for directions above the local horizon; that is, the value of $F_{+12}$ is reduced. As discussed above, to track low-elevated satellites, a large value of $F_{+12}$ is desirable.

Figure 5:
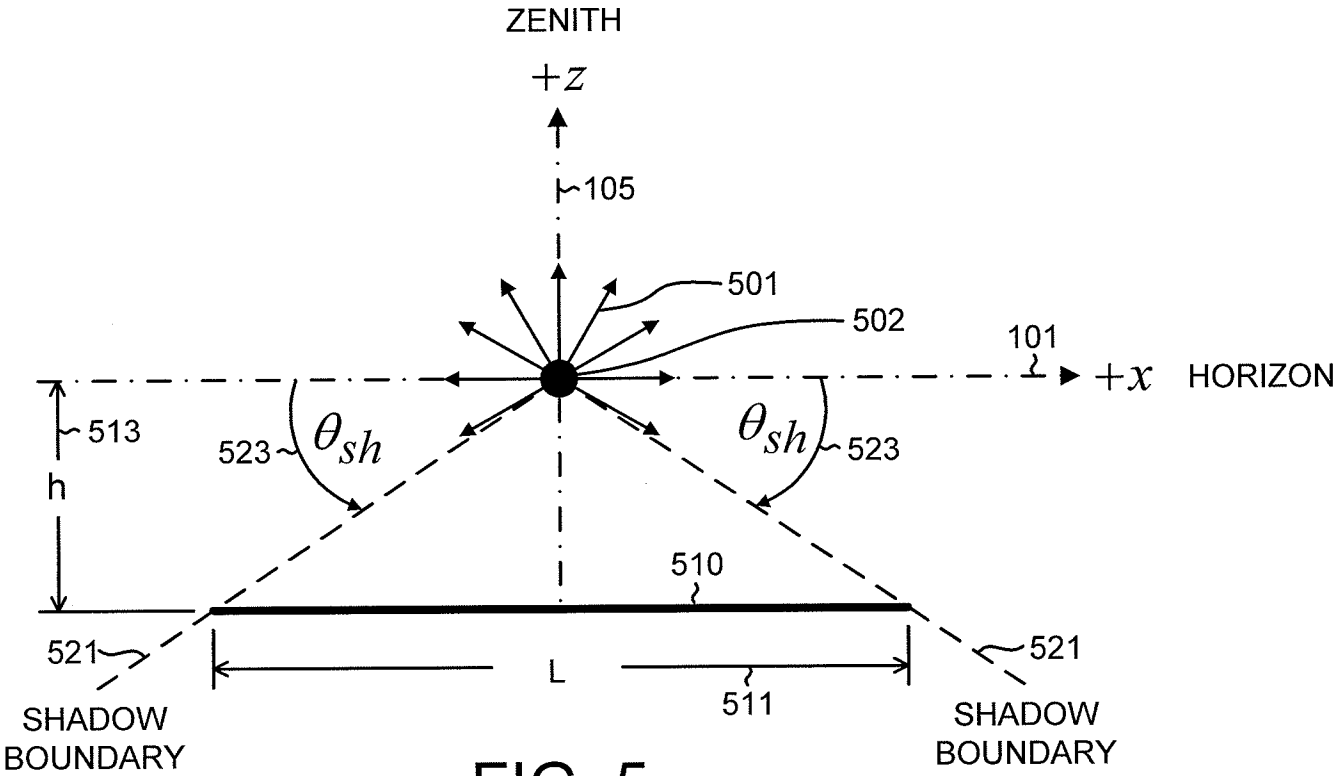
FIG. 5 shows a schematic representation of shadowing of rays by a ground plane.

According to embodiments of the invention, in addition to increasing the size of the HCIS ground plane, the height of the antenna above the HCIS ground plane is increased. Refer to FIG. 5. The antenna 502 is positioned above the HCIS ground plane 510. The z-axis 105 is orthogonal to the HCIS ground plane 510 and passes through the geometrical center of the HCIS ground plane 510. The HCIS ground plane 510 has a characteristic lateral dimension L 511. For example, if the HCIS ground plane has a circular geometry, the characteristic lateral dimension L represents the diameter of the circle; similarly, if the HCIS ground plane has a square geometry, L represents the length of the side of the square. In general, the HCIS ground plane can have a user-defined geometry.

The height of the antenna 502 above the HCIS ground plane 510 is referenced as the height h 513 (measured along the z-axis). Vectors 501 represent the electromagnetic field radiating from the antenna 502 (in the transmit mode). For transmission below the horizon, signals with an elevation angle greater than $\theta_{sh}$ 523 are shadowed by the HCIS ground plane 510. The shadow angle $\theta_{sh}$ 523 is delimited by the shadow boundary 521 determined by the rays from the antenna 502 to the perimeter of the HCIS ground plane 510.

As the height h increases, the antenna pattern widens; that is the value of $F_{+12}$ increases (improves). As the height h increases, however, the shadow angle $\theta_{sh}$ also increases; that is the value of $F_{-12}$ increases (degrades). As discussed above, the capability of an antenna to suppress multipath reception can be characterized by the down/up ratio DU ($\theta^e$). One figure of merit for an antenna is the down/up ratio for $\theta^e$=12 deg:

$$DU(\theta^e \mid \theta^e = 12deg) = \frac{F(-\theta^e \mid \theta^e = 12deg)}{F(\theta^e \mid \theta^e = 12deg)} = \frac{F_{-12}}{F_{+12}}. \quad \text{(E6)}$$

Expression (E6) is written in relative units. If DU ($\theta^e$) is expressed in dB, then from (E2), $$DU_{12}\,(\text{dB}) = (F_{-12} - F_{+12})(\text{dB}). \quad \text{(E7)}$$

As discussed above, to maximize the suppression of multipath signals, the value of $DU_{12}$ should be minimized.

Figure 6A:
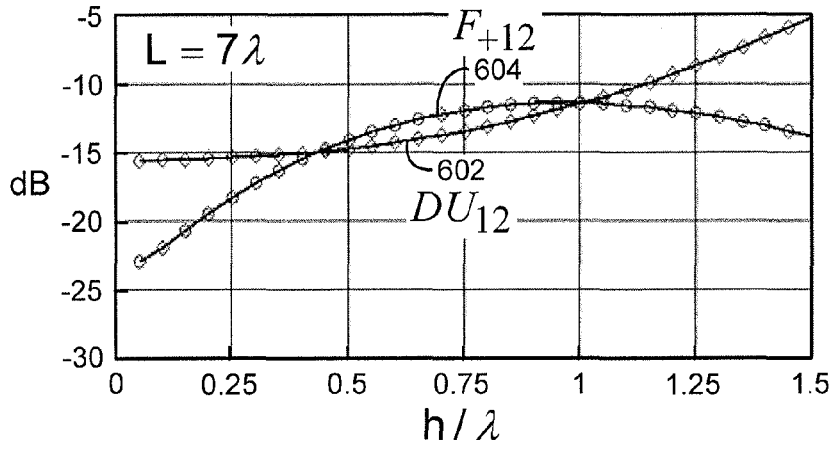
FIG. 6A-FIG. 6C show plots of the parameters $F_{+12}$ and $DU_{12}$ as a function of the normalized height of an antenna above a high capacitive impedance surface ground plane.
Figure 6B:
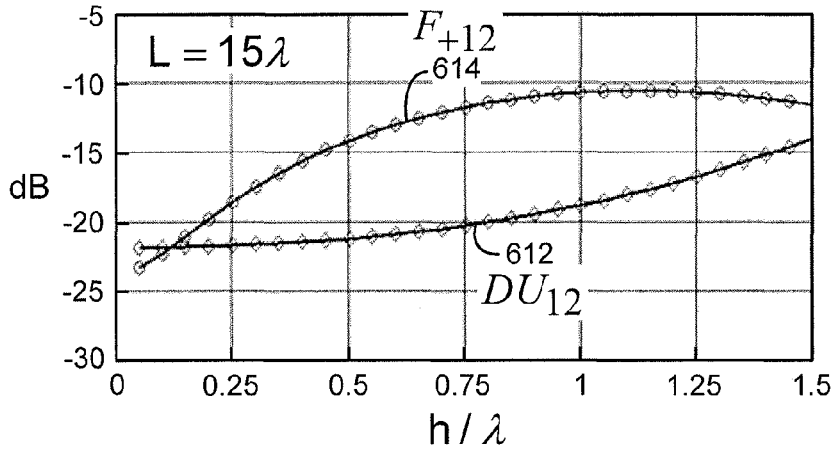
Figure 6C:
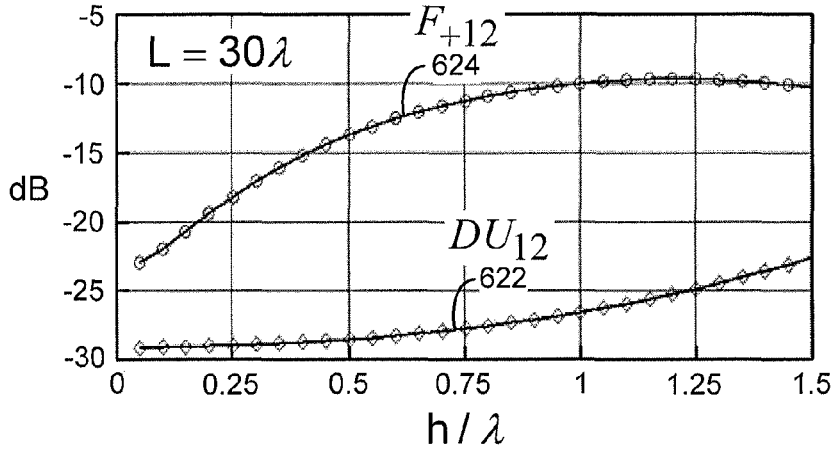

FIG. 6A-FIG. 6C show plots of $DU_{12}$ and $F_{+12}$ as a function of h for different values of L. The plots are the results of mathematical modelling. In the figures, the horizontal axis represents the normalized height (h/λ), where λ is the wavelength of electromagnetic radiation transmitted from or received by the antenna. When an antenna system is designed to operate over a specific frequency band of interest (ranging from the lowest frequency to the highest frequency of interest), the value λ corresponds to the wavelength of the lowest frequency in the specific frequency band of interest; that is, the longest operational wavelength. The vertical axis represents power levels or power level differences in dB. FIG. 6A shows $DU_{12}$ (plot 602) and $F_{+12}$ (plot 604) as a function of normalized height for L=7λ. FIG. 6B shows $DU_{12}$ (plot 612) and $F_{+12}$ (plot 614) as a function of normalized height for L=15λ. FIG. 6C shows $DU_{12}$ (plot 622) and $F_{+12}$ (plot 624) as a function of normalized height for L=30λ.

Over the range of heights h from about 0 to about (0.5-0.6)λ, the value of $F_{+12}$ increases rapidly; however, the value of $DU_{12}$ remains nearly constant; this relationship holds true for all three values of L. For reliable tracking of low-elevated satellites, an $F_{+12}$ value of about −12 dB to about −14 dB is sufficient. From mathematical modelling, this range of $F_{+12}$ can be attained for values of h from about 0.4λ to about 0.6λ. Experimental measurements with antennas commonly used for GNSSs have verified that this range of $F_{+12}$ can be attained for values of h from about 0.25λ to about 0.6λ.

Figure 8:
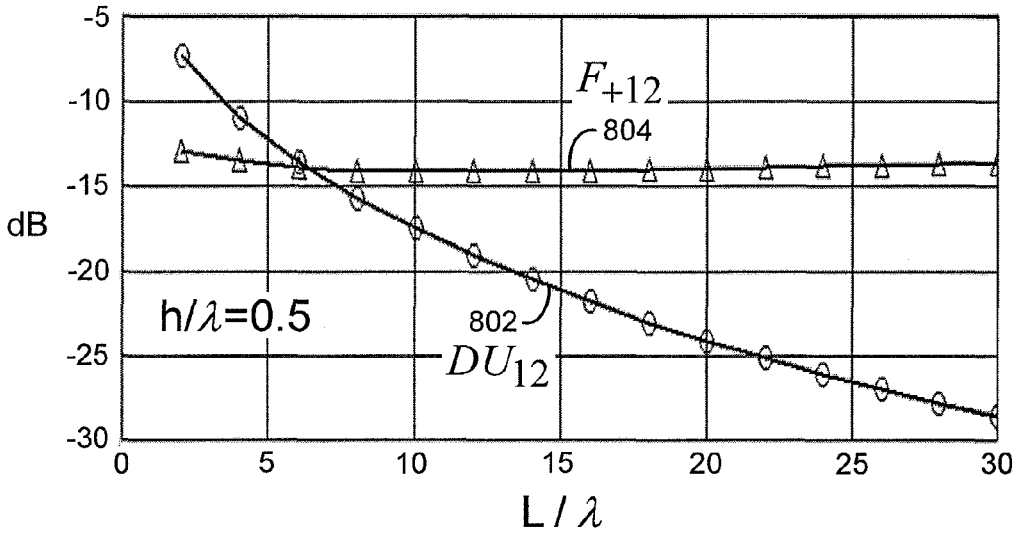
FIG. 8 shows plots of the parameters $F_{+12}$ and $DU_{12}$ as a function of the normalized lateral dimension of a high capacitive impedance surface ground plane.

Further analysis shows that for a constant value of h, as L increases, $DU_{12}$ decreases, while the value $F_{+12}$ can remain approximately constant over the range of about −12 dB to about −14 dB. In FIG. 8, the horizontal axis represents the normalized lateral dimension (L/λ). The vertical axis represents power levels or power level differences in dB. Shown for h=0.5λ are values of $DU_{12}$ (plot 802) and (plot 804). Over the range of L from (1-30)λ, the value of $F_{+12}$ remains within the range of about −12 dB to about −14 dB, while the value of $DU_{12}$ decreases as L increases. Therefore, while maintaining an acceptable value of $F_{+12}$, a desired (target design) value of $DU_{12}$ can be attained with a sufficiently large value of L. This result is unexpected and can be utilized for good advantage for GNSS applications.

Figure 7A:
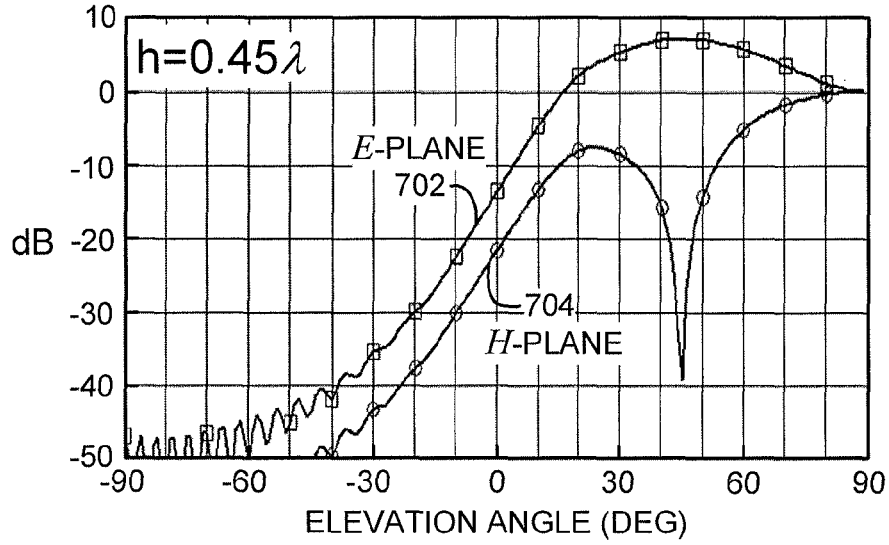
FIG. 7A-FIG. 7C show plots of antenna pattern levels as a function of elevation angle.
Figure 7B:
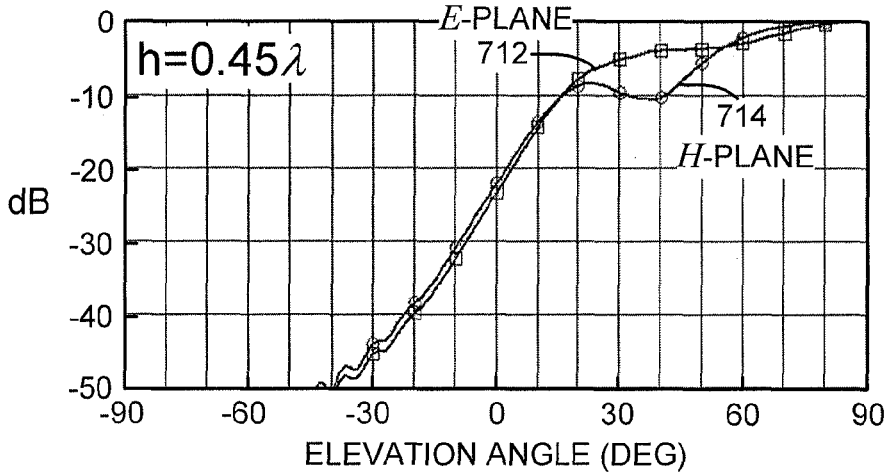
Figure 7C:
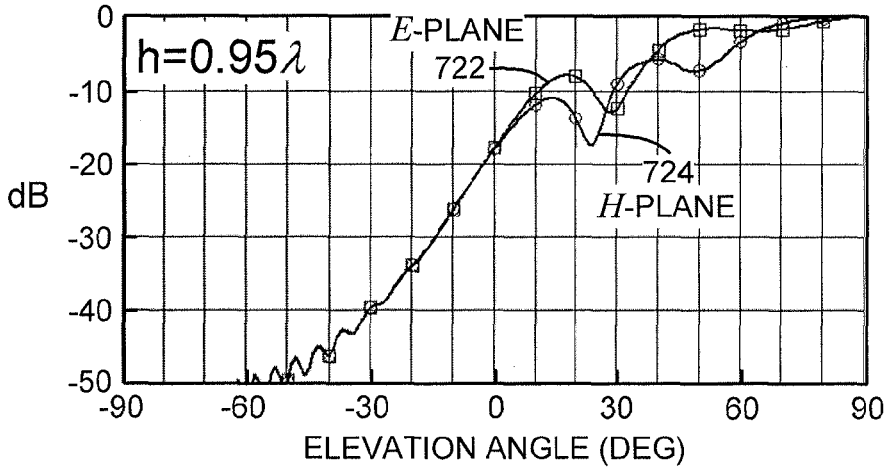

The above analysis was performed with F ($\theta^e$) represented as the square root of the total power; this analysis assumes that direct and reflected signals are matched with respect to polarization. GNSS signals, however, are circularly polarized; in particular, right-hand circularly polarized (RHCP). More detailed analysis considers the antenna patterns for the electric field plane (E-plane) and the magnetic field plane (H-plane) separately. FIG. 7A-FIG. 7C show plots of the antenna patterns for different configurations of antenna systems. The horizontal axis represents the elevation angle in deg; the vertical axis represents the antenna pattern level in dB.

FIG. 7A shows the results for an antenna at a height h=0.45λ above a HCIS ground plane. In this configuration, the antenna has a homogenous omnidirectional pattern; that is, the antenna pattern in the downward direction (towards the HCIS ground plane) is the same as the antenna pattern in the upward direction (toward the sky). Plot 702 shows the E-plane antenna pattern; plot 704 shows the H-plane antenna pattern. In plot 704, there is a deep signal drop in the H-plane antenna pattern over the elevation angle range from about 40 deg to about 50 deg. This drop degrades the polarization characteristics of a circularly polarized antenna and results in unacceptable performance.

FIG. 7B shows the results for a different antenna, also at a height h=0.45λ above a HCIS ground plane. In this configuration, the antenna is directional, with a down/up ratio in the nadir direction of −15 dB. Plot 712 shows the E-plane antenna pattern; plot 714 shows the H-plane antenna pattern. There is at most about a 5 dB drop in the H-plane antenna pattern level relative to the E-plane antenna pattern level. Performance for a circularly polarized antenna is not adversely affected. In practice, an antenna with a down/up ratio in the nadir direction of about −12 dB or less can be combined with a HCIS ground plane to provide satisfactory performance of the antenna system. Since many commercially available GNSS antennas have this characteristic, antenna systems according to embodiments of the invention can advantageously be manufactured with commercially available GNSS antennas.

FIG. 7C shows the results for the same directional antenna as used to acquire the results in FIG. 7B, but at a height h=0.95λ above a HCIS ground plane. These plots illustrate what happens when the range of h from about 0.25λ to about 0.6λ is exceeded. Plot 722 shows the E-plane antenna pattern; plot 724 shows the H-plane antenna pattern. Above the horizon there are oscillations in the antenna pattern for both the E-plane and the H-plane. These oscillations degrade antenna performance. Thus the limits of h from about 0.25λ to about 0.6λ yield a proper range of $F_{+12}$, a proper range of $DU_{12}$, and a smooth variation of the antenna pattern for both the E-plane and the H-plane.

Figure 11A:
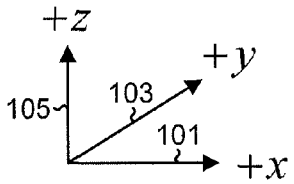
FIG. 11A-FIG. 11D show schematics of an embodiment of a high capacitive impedance surface ground plane.
Figure 11C:
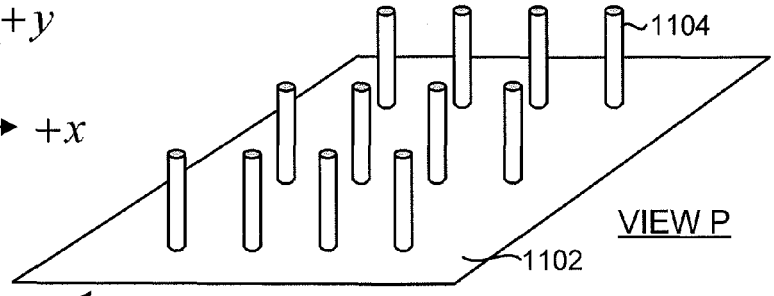
Figure 11B:
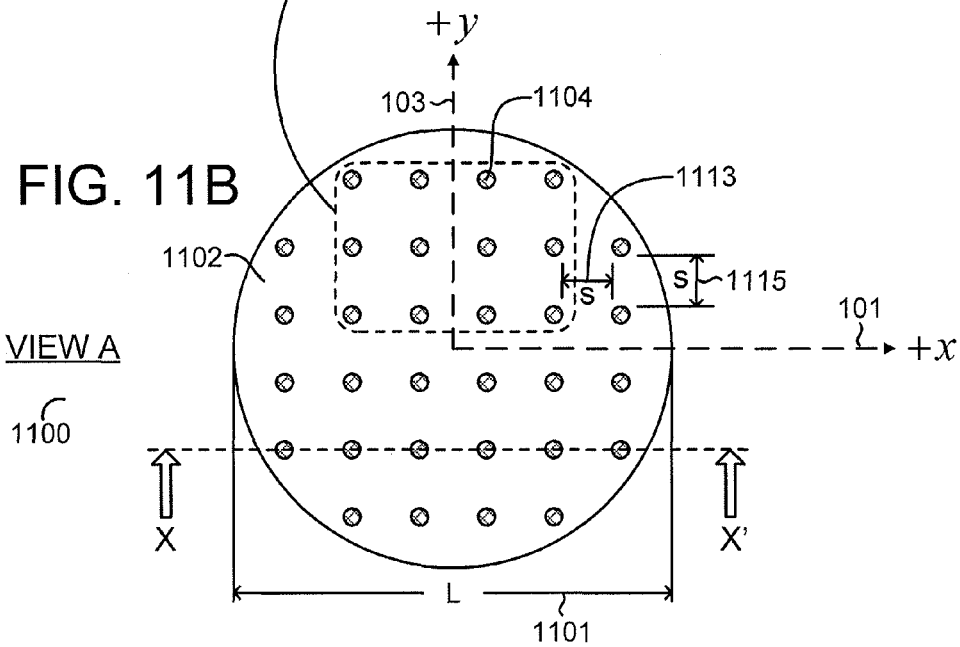
Figure 11D:
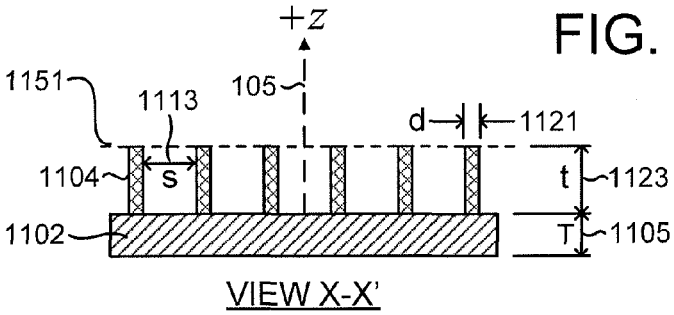

A variety of mechanical structures can be used to implement a HCIS ground plane. Some mechanical structures comprise an array of conducting elements. A ground plane in which the array of conducting elements is an array of conducting pins is advantageous because it has a broadband frequency response. FIG. 11A-FIG. 11D show a HCIS ground plane suitable for the entire GNSS frequency band from about 1165 MHz to about 1605 MHz. FIG. 11A shows a reference Cartesian coordinate system with X-axis 101, y-axis 103, and Z-axis 105. FIG. 11B shows a plan view (View A), sighted along the −z-axis, of the HCIS ground plane 1100. FIG. 11C shows a perspective view (View P) of a portion of the HCIS ground plane. FIG. 11D shows a cross-sectional view (View X-X') of a portion of the HCIS ground plane.

The HCIS ground plane 1100 includes a flat conducting plate 1102 and an array of conducting pins 1104 electrically connected to the flat conducting plate 1102. FIG. 11C shows a magnified perspective view of a portion of the array of conducting pins. Refer to FIG. 11B. The flat conducting plate 1102 has a circular geometry with a diameter L 1101. The array of conducting pins 1104 are configured on a square matrix; the spacing between the pins along the x-axis is s 1113, and the spacing between the pins along the y-axis is s 1115. Refer to FIG. 11D. The flat conducting plate 1102 has a thickness (height) T 1105. The array of conducting pins 1104 are orthogonal to the flat conducting plate 1102. Each conducting pin is cylindrical, with a diameter d 1121 and a length (height) t 1123. The high capacitive impedance surface 1151, shown as a dashed line, lies across the top of the array of conducting pins 1104.

In an embodiment, the value of the spacing s ranges from about 0.2λ to about 0.4λ. The maximum value of the diameter d is about one-eighth of the spacing s. For the GNSS frequency band, the value of the diameter d can range from about 4 mm to about 8 mm; the pins can then be screws that are screwed into the flat conducting plate 1102. Since resonance occurs for a pin length (height) t of a quarter wavelength, for an HCIS ground plane, the value of t should be slightly larger than 0.25λ; for example, about 0.255λ to about 0.260λ. For a frequency of 1150 MHz, the value of t ranges from about 66 mm to about 68 mm.

Figure 10A:
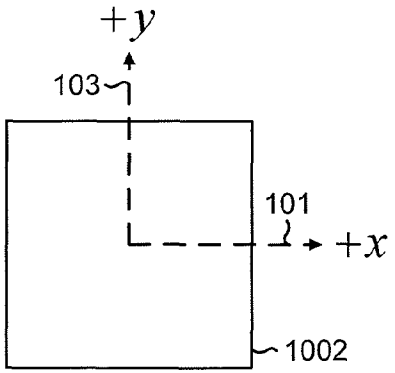
FIG. 10A-FIG. 10D show schematics of various geometries for flat conducting plates.
Figure 10C:
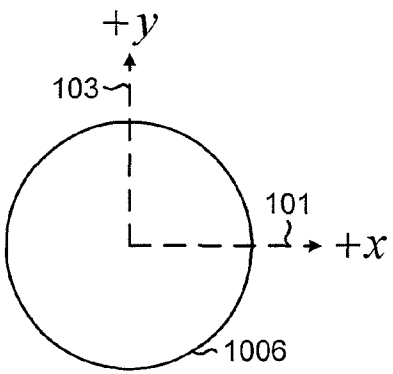
Figure 10B:
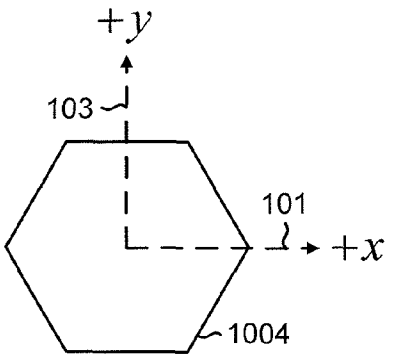
Figure 10D:
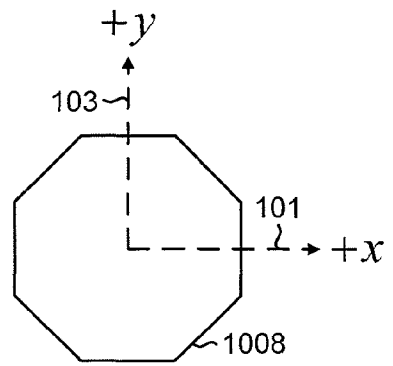

The flat conducting plate can have various geometries. FIG. 10A-FIG. 10D show some examples. The plane of the figures is the x-y plane, orthogonal to the z-axis. In FIG. 10A, the flat conducting plate 1002 has a square geometry. In FIG. 10B, the flat conducting plate 1004 has a hexagonal geometry. In FIG. 10C, the flat conducting plate 1006 has a circular geometry. In FIG. 10D, the flat conducting plate 1008 has an octagonal geometry. For GNSS applications, the flat conducting plate is symmetric about the z-axis and can therefore have, for example, the geometry of a circle or a regular polygon. For other applications in which axial symmetry is not required, other geometries such as ellipses, rectangles, and non-regular polygons can be used.

With proper scaling of dimensions according to the wavelength λ received by or transmitted from the antenna system, embodiments of the HCIS ground plane can be configured for various frequencies. In an embodiment, an antenna system operates at 5700 MHz, which corresponds to a wavelength of λ equal to 5.26 cm. The flat conducting plate has a circular geometry, and the array of conducting pins is configured on a square matrix (see FIG. 11A-FIG. 11D). The diameter of the flat conducting plate is about 13.5λ (71 cm).

The spacing s between conducting pins is about 0.2λ (1.1 cm). The length t of the conducting pins is about 0.3λ (1.6 cm). The antenna is positioned above the HCIS ground plane at a height ranging from about 0.1λ (0.53 cm) to about 0.5λ (2.6 cm) above the high capacitive impedance surface passing across the tops of the conducting pins. The positioning of the antenna above the HCIS ground plane is similar to that shown in FIG. 12E, discussed below. A microstrip antenna with a λ/2 size local flat antenna ground plane was used (see discussion below for details of local flat antenna ground plane in reference to FIG. 12E). The microstrip antenna has a down/up ratio of −15 dB in the nadir direction.

Figure 9:
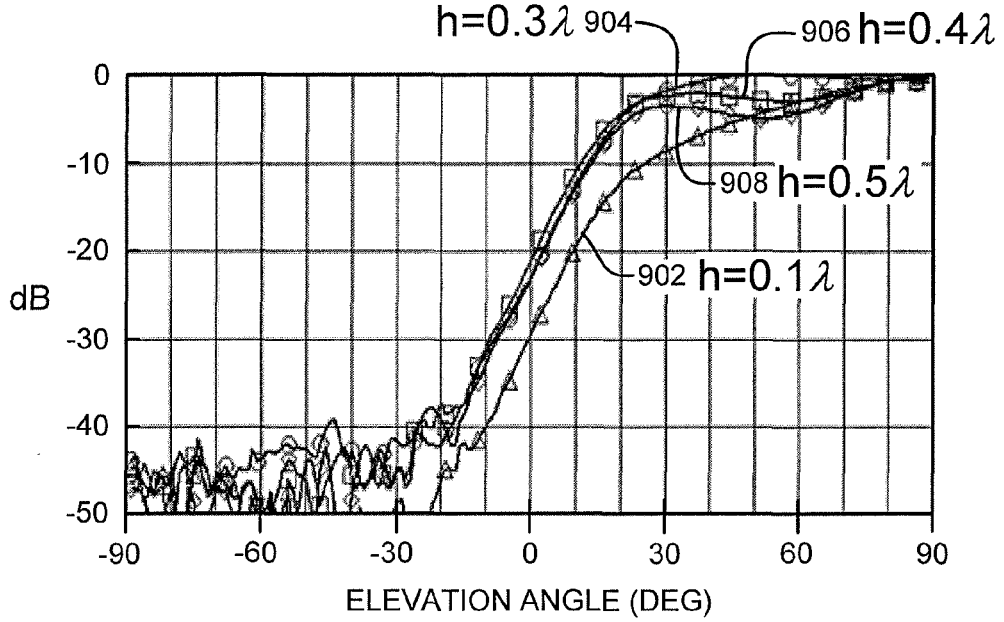
FIG. 9 shows plots of antenna pattern levels as a function of elevation angle.

FIG. 9 shows plots of the measured antenna patterns (normalized total flux power density) for different values of the height h. The horizontal axis represents the elevation angle in deg; the vertical axis represents the AP level in dB. Plot 902, plot 904, plot 906, and plot 908 show AP levels for h=(0.1, 0.3, 0.4, 0.5)λ, respectively. From these plots, the following results are attained for h≥0.3λ: $F_{+12}$ ranges from about −11 dB to about −9 dB; $F_{-12}$ ranges from about −35 dB to about −33 dB; $DU_{12}$ is less than −20 dB; and $F_{NADIR}$ is less than −40 dB.

From antenna engineering principles, if the antenna dimensions are scaled based on wavelength, the major operating characteristics will stay substantially the same. The antenna system described above for 5700 MHz operation can then be scaled for GNSS operation while maintaining substantially the same values of $F_{+12}$, $F_{-12}$, $DU_{12}$, and $F_{NADIR}$. For a GNSS frequency of 1170 MHz, the corresponding wavelength λ is 25.6 cm. The HCIS ground plane diameter is 12λ=3.1 m; the pin length is 0.26λ=6.7 cm; and the height of the antenna over the tops of the pins is 0.3λ=7.7 cm.

Therefore the antenna performance parameters for antenna systems according to embodiments of the invention significantly exceed those of a conventional choke-ring antenna: both better multipath suppression and better low-elevated satellite tracking are simultaneously achieved. The improved multipath suppression results in a positioning error of about +/−1 mm, an order of magnitude improvement over the about +/−1 cm positioning error attained with conventional choke-ring antennas.

Figures 12E, 12F:
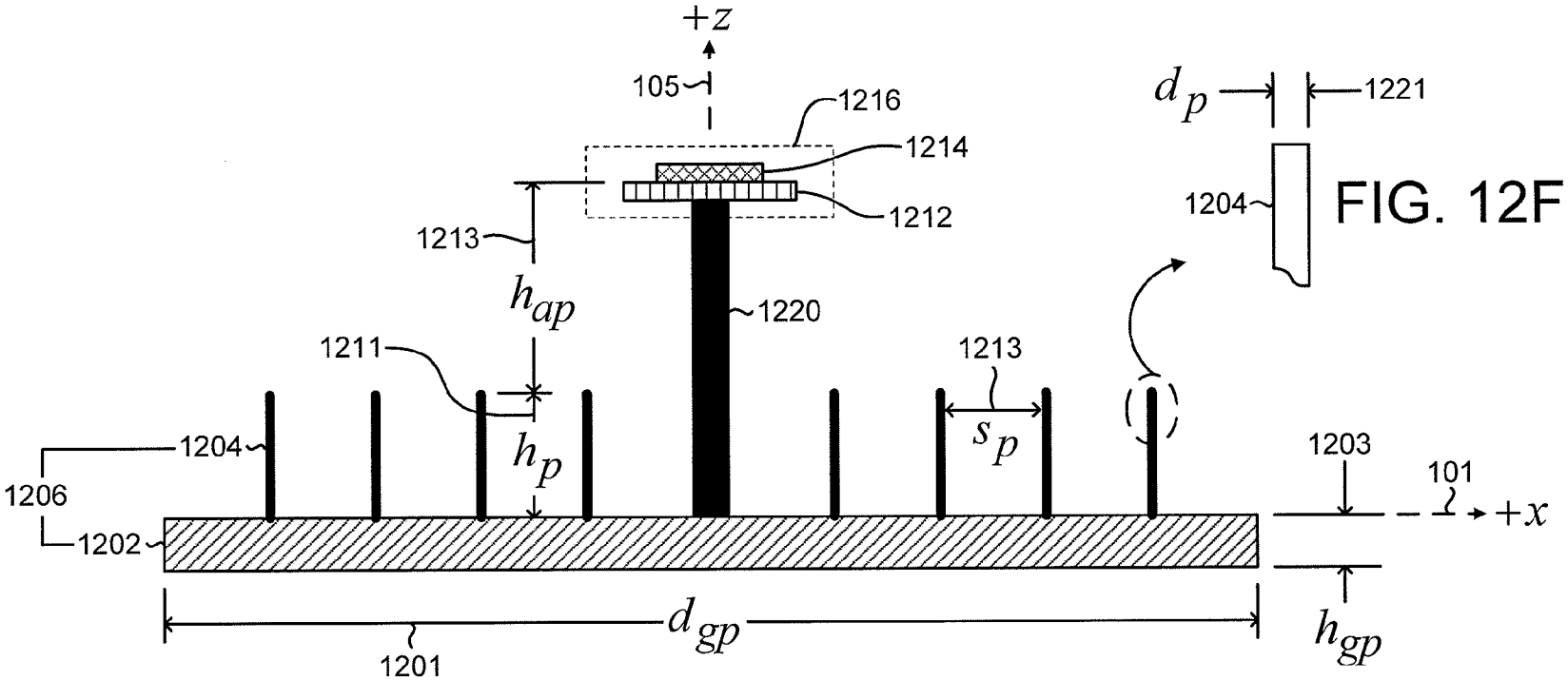

FIG. 12A-FIG. 12F show an antenna system 1200, according to an embodiment of the invention, configured for GNSS applications. FIG. 12A shows a reference Cartesian coordinate system with x-axis 101, y-axis 103, and z-axis 105. FIG. 12B shows a plan view (View A), sighted along the −z-axis, of the antenna system 1200. FIG. 12C shows a perspective view (View P) of a portion of the HCIS ground plane 1206. FIG. 12D shows a side view (View B), sighted along the +y-axis, of the antenna system 1200. FIG. 12E and FIG. 12F show a dimensional schematic, sighted along the +y-axis, of the antenna system 1200.

Refer to FIG. 12B and FIG. 12D. The antenna system 1200 includes a HCIS ground plane 1206 and an antenna 1216 mounted above the HCIS ground plane 1206 via a mounting post 1220. The HCIS ground plane 1206 is mounted on a support frame (not shown) which permits the HCIS ground plane 1206 to be oriented along a desired geographical reference plane. The HCIS ground plane 1206 includes a flat conducting plate 1202 and an array of conducting pins 1204. The flat conducting plate 1202 has a circular geometry. In this example, the flat conducting plate 1202 comprises 8 sectors 1208 that are mechanically fastened together (the sectors are all electrically connected). FIG. 12C shows a magnified perspective view of a central portion of the HCIS ground plane 1206. Shown are a portion of the flat conducting plate 1202 and a portion of the array of conducting pins 1204. Also shown in FIG. 12C is the mounting post 1220 (the antenna 1216 has been removed in this view).

The array of conducting pins 1204 are orthogonal to the flat conducting plate 1202. The array of conducting pins 1204 is electrically connected to the flat conducting plate 1202. In one embodiment, a pin is threaded and screwed into the flat conducting plate; the pin can be a conventional screw. A pin can also be fastened to the flat conducting plate by other means; for example, by a compression fit, by soldering, or by conductive epoxy. The high capacitive impedance surface (not shown) lies across the tops of the array of conducting pins 1204.

The array of conducting pins 1204 is configured along the top surface of the flat conducting plate 1202 such that they have azimuthal symmetry about the z-axis. In general, the spacing between any two adjacent pins can vary as a function of position across the top surface of the flat conducting plate; that is, the spacing between any two adjacent pins can vary as a function of x-y coordinate (or equivalently as a function of radius and polar angle in a polar coordinate system). The array of conducting pins 1204 is further configured such that the spacing between adjacent pins has the smallest deviation from the average spacing, where the average spacing is calculated from the spacings between adjacent pins over the entire top surface of the flat conducting plate. The diameter of each pin, the length of each pin, and the spacing between adjacent pins are determined to attain the highest capacitive impedance within the required bandwidth (the guidelines discussed above for the 5700 MHz antenna system apply for a GNSS antenna system).

Refer to the dimensional schematic shown in FIG. 12E and FIG. 12F. For an antenna operating in the GNSS range (1165 MHz-1605 MHz), the following design guidelines are used:

- $d_{gp}$, diameter 1201 of the flat conducting plate 1202. The value of $d_{gp}$ is selected to provide the required value of $DU_{12}$. To achieve a value of $DU_{12}$≤−20 dB, the value of $d_{gp}$ is greater than or equal to about 3 m.
- $d_p$, diameter 1221 of a pin 1204 (see magnified view in FIG. 12F). The value of $d_p$ ranges from about 3 mm to about 10 mm.
- $h_p$, height 1211 of the top of the pins 1204 above the top surface of the flat conducting plate 1202. The value of $h_p$ ranges from about 60 mm to about 75 mm.
- $h_{ap}$, height 1213 of the antenna 1216 above the tops of the pins 1204. The value of $h_{ap}$ ranges from about 70 mm to about 90 mm. Note that for GNSS applications, the antenna 1216 itself includes an antenna element 1214 and an antenna ground plane 1212. The antenna element is typically referred to as the radiating element in the transmit mode. As discussed above, in one example, the antenna 1216 is a microstrip antenna; for a microstrip antenna, the antenna ground plane 1212 is a flat ground plane. In another example, the antenna 1216 is a choke-ring antenna, and the antenna ground plane 1212 is a choke-ring ground plane. Where the antenna 1216 has a significant height of its own along the z-axis, the height $h_{ap}$ is measured from the top of the pins 1204 to the top of the antenna ground plane 1212.
- $S_p$, spacing 1213 between adjacent pins. As discussed above, the value of $S_p$ can vary across the surface of the flat conducting plate 1202. In an embodiment, the average value of $S_p$ is about 40 mm. The total number of pins is about 5500.

$h_{gp}$, height (thickness) 1203 of the flat conducting plate 1202. This value depends on the diameter $d_{gp}$ and on the construction material. It is selected to maintain structural support, flatness, and stability.

As described above, the pins (such as pin 1104 in FIG. 11A-FIG. 11D and pin 1204 in FIG. 12A-FIG. 12F) have a cylindrical geometry: the cross-sectional geometry orthogonal to the longitudinal axis is a circle. In other embodiments, pins can have other geometries; for example, the cross-sectional geometry orthogonal to the longitudinal axis can be an ellipse, a square, a rectangle, a hexagon, an octagon, or other polygon. In general, the cross-sectional geometry orthogonal to the longitudinal axis can be user-defined.

In other embodiments, the conducting elements in the array of conducting elements have more complex geometries than pins. For example, the conducting elements can be pins with expanded tips (expanded tips are also referred to herein as heads); the expanded tips are on the free top ends of the pins, pointing away from the flat conducting plate. Relative to a plain pin, a pin with an expanded tip permits the use of a conducting element with an overall smaller height (length); for example, the overall height (length) can be less than or equal to one-quarter wavelength. [Referring to FIG. 18B, for example, the overall height is the height 1815.] A pin with an expanded tip also allows adjustment of the structure of the HCIS ground plane to attain the highest capacitive impedance within the desired frequency range. The expanded tips can have various user-defined geometries. Some examples are shown in FIG. 14A-FIG. 14C, FIG. 15A-FIG. 15C, FIG. 16A-FIG. 16C, and FIG. 17A-FIG. 17C. In each example, an expanded tip (or head) is attached to a pin. As discussed above, a pin can have various geometries; for simplicity, a pin with a cylindrical geometry is shown. To simplify the drawings, the same pin (referenced as pin 1402) is shown in all the examples.

In general, a pin has a longitudinal axis with a characteristic length (height) along the longitudinal axis and a characteristic lateral dimension orthogonal to the longitudinal axis. The characteristic length of the pin is greater than (typically much greater than) the characteristic lateral dimension of the pin. In general, an expanded tip has a characteristic length along the longitudinal axis of the pin and a characteristic lateral dimension orthogonal to the longitudinal axis of the pin. The characteristic length of the expanded tip is less than the characteristic length of the pin; the characteristic lateral dimension of the expanded tip is greater than the characteristic lateral dimension of the pin.

Figures 14A, 14B, 14C, 15A, 15B, 15C, 16A, 16B, 16C, 17A, 17B, 17C:
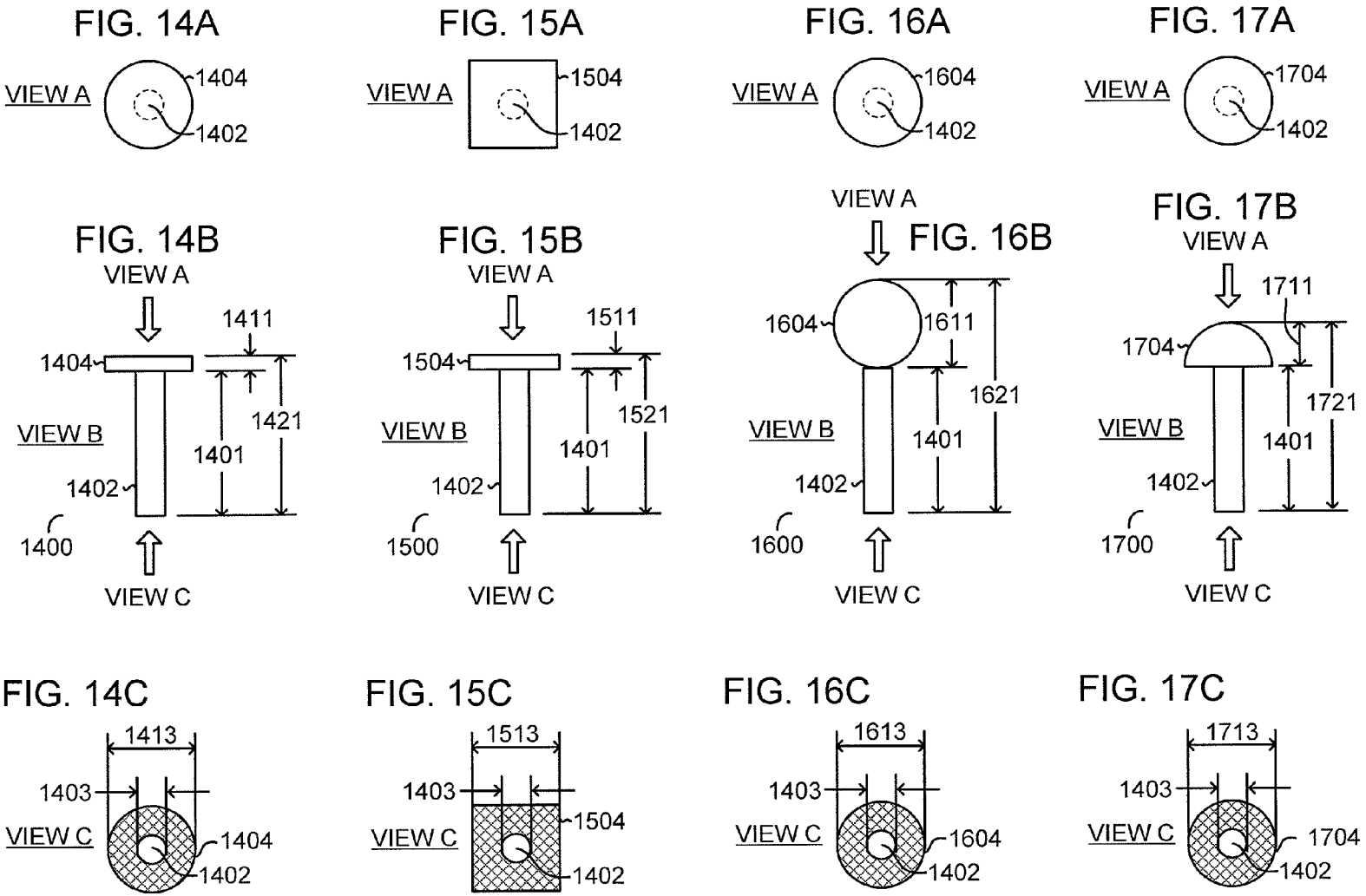
FIG. 14A-FIG. 14C shows schematics of an embodiment of a pin with an expanded tip.
FIG. 15A-FIG. 15C shows schematics of an embodiment of a pin with an expanded tip.
FIG. 16A-FIG. 16C shows schematics of an embodiment of a pin with an expanded tip; and FIG. 17A
-FIG. 17C shows schematics of an embodiment of a pin with an expanded tip.

Refer to FIG. 14A-FIG. 14C. FIG. 14B shows a side view (View B); FIG. 14A shows a top view (View A); and FIG. 14C shows a bottom view (View C). The conducting element 1400 includes a pin 1402 and an expanded tip 1404. The pin 1402 has a length 1401 and a diameter 1403. The expanded tip 1404 has the geometry of a cylinder, with a length 1411 and a diameter 1413. The length 1411 is less than the length 1401; the diameter 1413 is greater than the diameter 1403. The overall length of the conducting element 1400 is the length 1421.

Refer to FIG. 15A-FIG. 15C. FIG. 15B shows a side view (View B); FIG. 15A shows a top view (View A); and FIG. 15C shows a bottom view (View C). The conducting element 1500 includes a pin 1402 and an expanded tip 1504. The pin 1402 has a length 1401 and a diameter 1403. The expanded tip 1504 has the geometry of a square prism, with a length 1511 and a lateral dimension 1513. The length 1511 is less than the length 1401; the lateral dimension 1513 is greater than the diameter 1403. The overall length of the conducting element 1500 is the length 1521.

Refer to FIG. 16A-FIG. 16C. FIG. 16B shows a side view (View B); FIG. 16A shows a top view (View A); and FIG. 16C shows a bottom view (View C). The conducting element 1600 includes a pin 1402 and an expanded tip 1604. The pin 1402 has a length 1401 and a diameter 1403. The expanded tip 1604 has the geometry of a sphere, with a length 1611 and a lateral dimension 1613. In this case, both the length 1611 and the lateral dimension 1613 are equal to the diameter of the sphere. The diameter of the sphere is less than the length 1401; the diameter of the sphere is greater than the diameter 1403. The overall length of the conducting element 1600 is the length 1621.

Refer to FIG. 17A-FIG. 17C. FIG. 17B shows a side view (View B); FIG. 17A shows a top view (View A); and FIG. 17C shows a bottom view (View C). The conducting element 1700 includes a pin 1402 and an expanded tip 1704. The pin 1402 has a length 1401 and a diameter 1403. The expanded tip 1704 has the geometry of a hemisphere, with a length 1711 and a lateral dimension 1713. In this case, the length 1711 is equal to the radius of the hemisphere, and the lateral dimension 1713 is equal to the diameter of the hemisphere. The radius of the hemisphere is less than the length 1401; the diameter of the hemisphere is greater than the diameter 1403. The overall length of the conducting element 1700 is the length 1721.

Note that the pin and expanded tip structures shown in FIG. 14A-FIG. 14C, FIG. 15A-FIG. 15C, and FIG. 17A-FIG. 17C can be implemented with common screws or bolts (screws may have additional slots). In some instances, the pin and the expanded tip structure can be fabricated as a single piece. In other instances, the pin and the expanded tip can be fabricated as separate pieces and then joined together. For example, if the top of the pin is threaded, the expanded tip structure can be screwed onto the top of the pin; in some instances, the expanded tip can be a nut. Alternatively, the expanded tip structure can be attached to the pin by other means, such as solder or conductive epoxy.

As the characteristic length of the pin decreases and the characteristic lateral dimension of the expanded tip structure increases, a conducting element comprising a pin with an expanded tip structure becomes a conducting element referred to as a mushroom structure. For example, the characteristic overall length (height) of the mushroom structure can be several hundredths of $\lambda$ up to a maximum of about $0.1\lambda$ to $0.15\lambda$, and the spacing between adjacent expanded tip structures can range from about $0.05\lambda$ to about $0.3\lambda$. [Referring to FIG. 18C, for example, the overall height is the height 1865, and the spacing between adjacent expanded tips is the spacing 1853.] An array of mushroom structures results in a low-profile HCIS ground plane; however, it has narrowband operation. It would be suitable, for example, for an antenna system operating over a single frequency band, such as the L1 band.

Figure 18A:
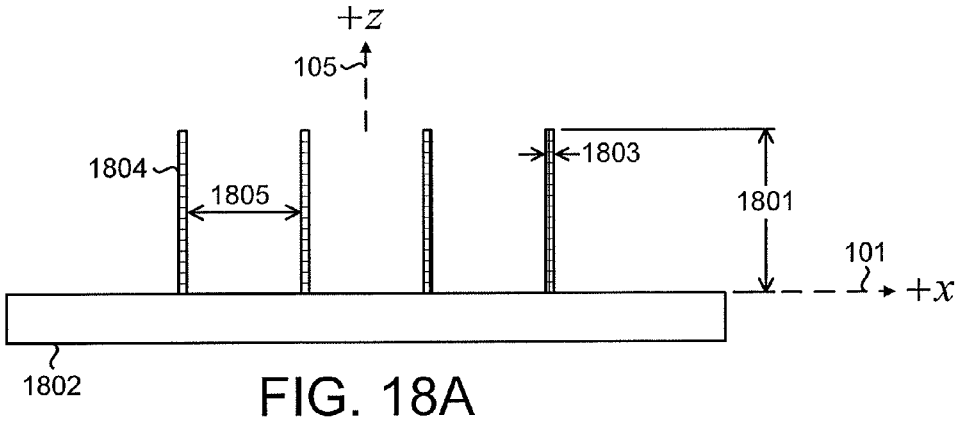
FIG. 18A-FIG. 18C show dimensional schematics of different embodiments of conducting elements.
Figure 18B:
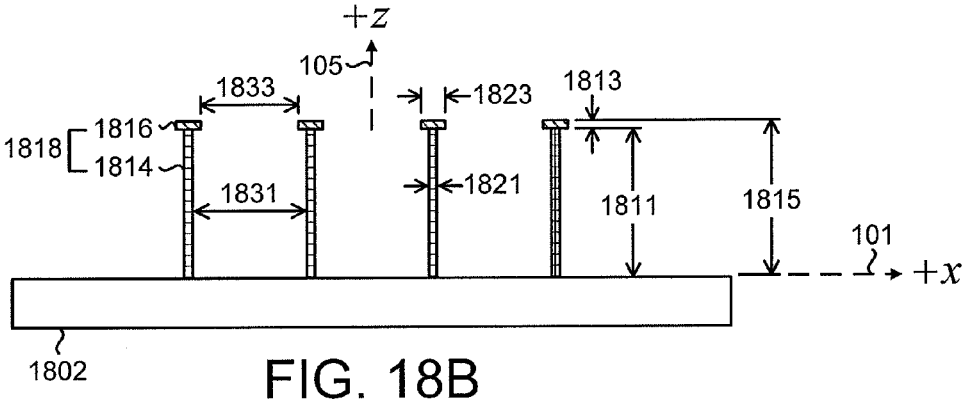
Figure 18C:
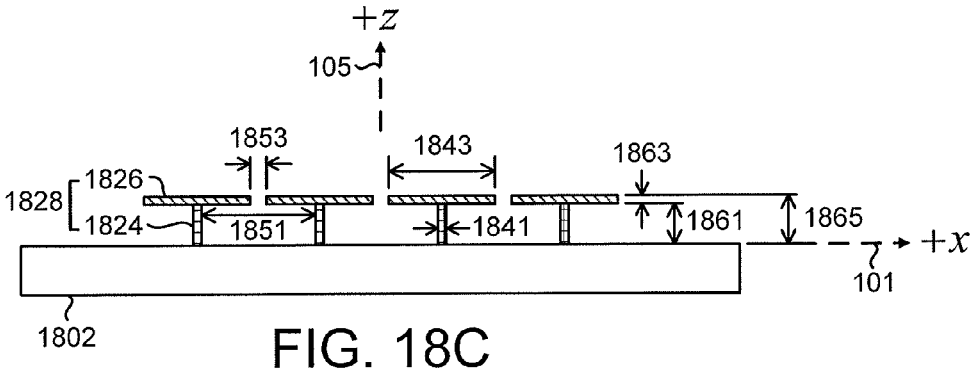

FIG. 18A-FIG. 18C show dimensional schematics for different embodiments of arrays of conductive elements, which are all shown mounted on a flat conducting plate 1802. In FIG. 18A, the conducting elements 1804 are cylindrical pins with a height 1801 and a diameter 1803. The spacing between adjacent pins is spacing 1805. In the example shown, the relative dimensions (arbitrary units) are diameter 1803: 1; height 1801: 20; spacing 1805: 14.

In FIG. 18B, the conducting elements 1818 comprise pins 1814 with expanded tips 1816. The overall height of the conducting elements 1818 is height 1815. The pins 1814 are cylindrical pins with a height 1811 and a diameter 1821. The expanded tips 1816 are discs with a height 1813 and a diameter 1823. The spacing between adjacent pins is spacing

1831. The spacing between adjacent expanded tips is spacing 1833. In the example shown, the relative dimensions (arbitrary units) are diameter 1821: 1; height 1811: 18; diameter 1823: 3; height 1813: 1; spacing 1831: 14; spacing 1833: 12; height 1815: 19.

In FIG. 18C, the conducting elements 1828 are mushroom structures comprising pins 1824 with expanded tips 1826. The overall height of the conducting elements 1828 is height 1865. The pins 1824 are cylindrical pins with a height 1861 and a diameter 1841. The expanded tips 1826 are discs with a height 1863 and a diameter 1843. The spacing between adjacent pins is spacing 1851. The spacing between adjacent expanded tips is spacing 1853. In the example shown, the relative dimensions (arbitrary units) are diameter 1841: 1; height 1831: 5; diameter 1843: 13; height 1833: 1; spacing 1851: 14; spacing 1853: 2; height 1835: 6.

FIG. 13A-FIG. 13C shows an antenna system, according to another embodiment of the invention, configured for GNSS applications. FIG. 13A shows a reference Cartesian coordinate system with x-axis 101, y-axis 103, and z-axis 105. FIG. 13B shows a plan view (View A), sighted along the −z-axis, of the antenna system 1300. FIG. 13C shows a cross-sectional view (View X-X') of the antenna system 1300.

The antenna system 1300 includes a HCIS ground plane 1308 and an antenna 1216 mounted above the HCIS ground plane 1308 via a mounting post 1320. The HCIS ground plane 1308 is a choke-ring ground plane, which operates over a narrower frequency range than the ground plane with an array of conducting pins described above. When a high degree of azimuthal symmetry is required, however, a choke-ring ground plane can be easier to manufacture than a ground plane with an array of conducting pins. The HCIS ground plane 1308 includes a flat conducting plate 1302; in the embodiment shown, the flat conducting plate 1302 has a circular geometry. Extending orthogonal to the flat conducting plate 1302 is an array of concentric conducting choke rings 1304 separated by an array of concentric choke grooves 1306. The high capacitive impedance surface (not shown) lies across the tops of the choke rings 1304 and choke grooves 1306.

FIG. 13C shows the primary design parameters:

- $d_{gp}$, diameter 1301 of the flat conducting plate 1302. The value of $d_{gp}$ is greater than about 2.5λ (greater than about 50 cm for GNSS).
- $t_r$, wall thickness 1317 of the choke ring 1304.
- $w_g$, width 1315 of the choke groove 1306.
- $h_g$, height 1311 of the top of the choke rings 1304 above the top surface of the flat conducting plate 1302.
- $h_{ag}$, height 1313 of the antenna 1216 above the tops of the choke rings 1304. The height 1313 is measured from the top of the antenna ground plane 1212 to the tops of the choke rings 1304 (compare the above discussion in reference to FIG. 12E). The value of $h_{ag}$ ranges from about 0.25λ to about 0.6λ, corresponding to about 70 mm to about 110 mm for GNSS.
- $h_{gp}$, thickness 1303 of the flat conducting plate 1302.

In embodiments of the invention, an antenna system includes an antenna positioned above a high capacitive impedance surface (HCIS) ground plane. The antenna system is configured to receive electromagnetic radiation with a wavelength λ. For GNSS applications, the electromagnetic radiation is circularly polarized. For GNSS applications, the frequency band ranges from 1165 MHz-1605 MHz; the corresponding wavelength λ ranges from about 18.7 cm to about 25.7 cm.

The antenna is selected to have a user-defined (target design) maximum value of the down/up ratio in the nadir direction. In an embodiment, the user-defined maximum value is about −12 dB to about −15 dB.

Figure 19A:
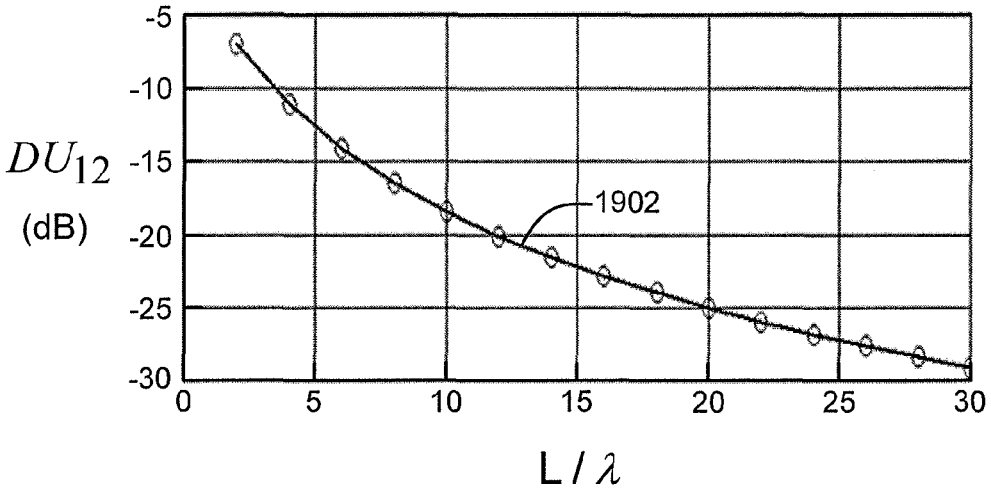
FIG. 19A shows a plot of the parameter $DU_{12}$ as a function of the normalized lateral dimension of a high capacitive impedance surface ground plane.

The characteristic lateral dimension L of the HCIS ground plane is selected such that the antenna system has a user-defined maximum value of the down/up ratio at a user-defined elevation angle corresponding to low-elevated satellites; the user-defined maximum value is selected to provide acceptable multipath suppression. In an embodiment, the user-defined elevation angle is 12 deg, and the value of L is selected according to plot 1902 in FIG. 19A. A fitted curve to the plot 1902 yields the relationship:

$$DU_{12}(L) = 3\left(\frac{L}{\lambda} + 2.45\right)^{-1.28}, \text{ or} \tag{E8A}$$

$$DU_{12}(L) = 20\log\left[3\left(\frac{L}{\lambda} + 2.45\right)^{-1.28}\right] \text{ in dB.} \tag{E8B}$$

Here $DU_{12}(L)$ represents the user-defined maximum value of the down/up ratio of the antenna system at the elevation angle of 12 deg. The value of L is then calculated by solving (E8A) or (E8B).

Figure 19B:
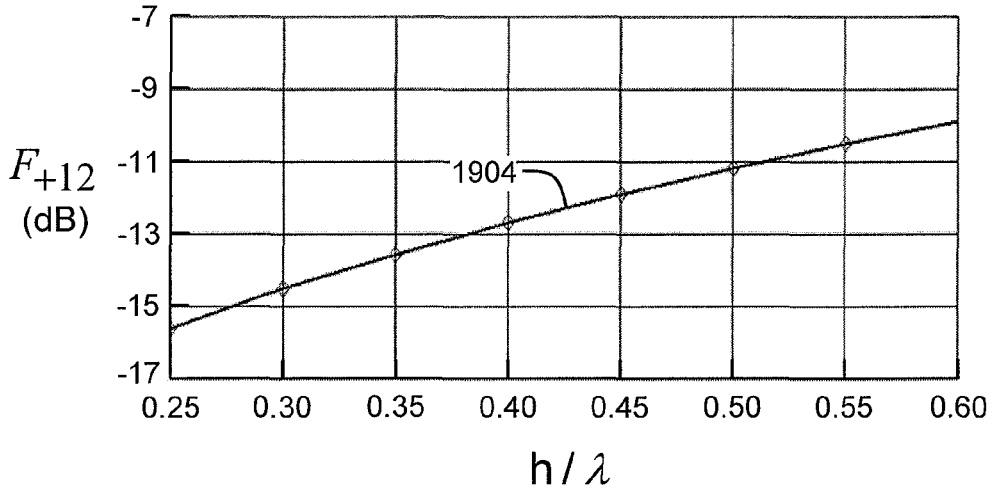
FIG. 19B shows a plot of the parameter $F_{+12}$ as a function of the normalized height of an antenna above a high capacitive impedance surface ground plane.

Once the value of L has been selected, the value of the height h of the antenna above the HCIS ground plane is selected such that the antenna system has a user-defined minimum value of the antenna pattern level at the user-defined elevation angle corresponding to low-elevated satellites. The minimum value is selected to provide adequate sensitivity to signals transmitted by low-elevated satellites. In an embodiment, the user-defined elevation angle is +12 degrees, and the value of h is selected according to the plot 1904 in FIG. 19B. A fitted curve to the plot 1904 yields the relationship:

$$F_{+12}(h)=0.438h/\lambda+0.064, \text{ or} \tag{E9A}$$

$$F_{+12}(h)=20 \log [0.438h/\lambda+0.064] \text{ in dB.} \tag{E9B}$$

Here $F_{+12}(h)$ represents the user-defined minimum value of the antenna pattern level of the antenna system at the elevation angle of +12 degrees. The value of h is then calculated by solving (E9A) or (E9B).

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An antenna system configured to receive circularly polarized electromagnetic radiation from a plurality of satellites in a global navigation satellite system, the antenna system comprising:

a high capacitive impedance surface ground plane having a characteristic lateral dimension; and an antenna positioned at a height above the high capacitive impedance surface ground plane;

wherein:

a down/up ratio of the antenna in a nadir direction has a maximum value;

the characteristic lateral dimension has a value such that a down/up ratio of the antenna system at an elevation angle has a maximum value; and the height has a value such that an antenna pattern level of the antenna system at the elevation angle has a minimum value; and wherein the elevation angle is 12 degrees;

wherein the characteristic lateral dimension is selected according to the formula $$DU_{12}(L) = 20\log\left[3\left(\frac{L}{\lambda} + 2.45\right)^{-1.28}\right] \text{ in dB,}$$

wherein:

λ represents a wavelength of the electromagnetic radiation;

L represents the characteristic lateral dimension; and $DU_{12}$ (L) represents the maximum value of the down/up ratio of the antenna system at the elevation angle of 12 degrees; and wherein the height is selected according to the formula $$F_{+12}(h)=20 \log [0.438h/\lambda+0.064] \text{ in dB,}$$

wherein:

h represents the height; and $F_{+12}$(h) represents the minimum value of the antenna pattern level at the elevation angle of +12 degrees.

2. The antenna system of claim 1 wherein the maximum value is about −12 dB to about −15 dB.

3. The antenna system of claim 1, wherein:

the elevation angle is about 12 degrees;

the maximum value of the down/up ratio of the antenna system at the elevation angle is about −20 dB; and the minimum value of the antenna pattern level at the elevation angle is about −12 dB to about −14 dB.

4. The antenna system of claim 1, wherein:

the electromagnetic radiation has a frequency ranging from a first frequency to a second frequency, wherein the second frequency is higher than the first frequency; and λ corresponds to the first frequency.

5. The antenna system of claim 1, wherein:

the value of L is greater than or equal to about 5λ; and the value of h is about 0.25λ to about 0.6λ.

6. The antenna system of claim 5, wherein:

the electromagnetic radiation has a frequency ranging from a first frequency to a second frequency, wherein the second frequency is higher than the first frequency; and λ corresponds to the first frequency.

7. The antenna system of claim 1, wherein the high capacitive impedance surface ground plane comprises:

a flat conducting plate; and an array of conducting elements electrically connected to the flat conducting plate and oriented orthogonal to the flat conducting plate.

8. The antenna system of claim 7, wherein the array of conducting elements comprises an array of conducting pins.

9. The antenna system of claim 8, wherein a height of a conducting pin in the array of conducting pins has a value of about 0.255λ to about 0.260λ, wherein λ represents a wavelength of the electromagnetic radiation.

10. The antenna system of claim 9, wherein:

the electromagnetic radiation has a frequency ranging from a first frequency to a second frequency, wherein the second frequency is higher than the first frequency; and λ corresponds to the first frequency.

11. The antenna system of claim 7, wherein the array of conducting elements comprises an array of conducting pins with expanded tips.

12. The antenna system of claim 7, wherein the array of conducting elements comprises an array of mushroom structures, wherein a height of a mushroom structure in the array of mushroom structures has a maximum value of about 0.1λ to about 0.15λ, wherein λ represents a wavelength of the electromagnetic radiation.

13. The antenna system of claim 12, wherein:

the electromagnetic radiation has a frequency ranging from a first frequency to a second frequency, wherein the second frequency is higher than the first frequency; and λ corresponds to the first frequency.

14. The antenna system of claim 1, wherein the high capacitive impedance ground plane comprises:

a flat conducting plate; and an array of conducting choke rings electrically connected to the flat conducting ground plane and oriented orthogonal to the flat conducting ground plane.

* * * * *